US010132504B1

(12) United States Patent
Springer et al.

(10) Patent No.: US 10,132,504 B1
(45) Date of Patent: Nov. 20, 2018

(54) DUAL COIL ELECTRIC HEATING ELEMENT

(71) Applicants: Stacy Springer, Murfreesboro, TN (US); Dan Maxwell, Murfreesboro, TN (US); Shahid Ikram, Goshen, KY (US); Mitch Taylor, Prospect, KY (US); Zachary Newcomb, Louisville, KY (US)

(72) Inventors: Stacy Springer, Murfreesboro, TN (US); Dan Maxwell, Murfreesboro, TN (US); Shahid Ikram, Goshen, KY (US); Mitch Taylor, Prospect, KY (US); Zachary Newcomb, Louisville, KY (US)

(73) Assignees: BACKER EHP INC., Murfreesboro, TN (US); WAKO (USA) INC., Louisville, KY (US)

( * ) Notice: Subject to any disclaimer, the term of this patent is extended or adjusted under 35 U.S.C. 154(b) by 0 days.

(21) Appl. No.: 15/716,240

(22) Filed: Sep. 26, 2017

Related U.S. Application Data

(60) Provisional application No. 62/506,498, filed on May 15, 2017.

(51) Int. Cl.
*H05B 1/02* (2006.01)
*F24C 7/08* (2006.01)
(Continued)

(52) U.S. Cl.
CPC ..... *F24C 7/087* (2013.01); *F24C 7/062* (2013.01); *F24C 7/081* (2013.01); *H05B 3/748* (2013.01)

(58) Field of Classification Search
CPC ..... F24C 7/087; F24C 7/062; F24C 7/081; F24B 3/748; H05B 1/0213;
(Continued)

(56) References Cited

U.S. PATENT DOCUMENTS 2,472,738 A * 6/1949 Backer ..... F24C 15/104 219/459.1
2,806,122 A * 9/1957 Thunander ..... G05D 23/1913 219/448.14
(Continued)

FOREIGN PATENT DOCUMENTS

CA 2970348 12/2017

*Primary Examiner* — Mark Paschall
(74) *Attorney, Agent, or Firm* — Neal, Gerber & Eisenberg LLP; Thomas E. Williams

(57) ABSTRACT

An embodiment of an electric heating element is disclosed, including an electrically resistive inner heating element, an electrically resistive outer heating element, and a thermostat positioned along a cold leg of the inner heating element. The thermostat is configured to selectively allow electrical current to be delivered to the inner heating element while maximum electrical current, for example, continues to be provided to the outer heating element. The thermostat cycles the electrical current on and off when detecting maximum and minimum desired temperatures radiated from the electric heating element. The inner heating element has a pair of cold legs that extend parallel to a pair of cold legs of the outer heating element, some or all of which may be supported by a terminal bracket.

25 Claims, 16 Drawing Sheets

(51) Int. Cl.
*F24C 7/06* (2006.01)
*H05B 3/74* (2006.01)

(58) Field of Classification Search
CPC ..... H05B 2203/0266; H05B 2203/007; H05B 1/0263; H05B 3/08
USPC .... 219/497, 490, 492, 443.1, 446.1, 448.12, 219/448.11, 448.16, 462.1
See application file for complete search history.

(56) References Cited

U.S. PATENT DOCUMENTS 4,122,330 A * 10/1978 Fischer ..... F24C 15/105 219/448.11
4,538,051 A * 8/1985 Schreder ..... H05B 3/748 219/457.1
5,270,519 A * 12/1993 Higgins ..... F24C 15/106 219/448.19
5,294,778 A * 3/1994 Carman ..... H01L 21/67103 118/725
5,396,047 A * 3/1995 Schilling ..... F24C 15/106 219/448.11
5,498,854 A * 3/1996 McWilliams ..... H05B 3/748 219/449.1
6,246,033 B1 6/2001 Shah
6,300,605 B1 * 10/2001 Higgins ..... H05B 3/748 219/448.11
7,053,340 B2 * 5/2006 Wilde ..... H05B 3/746 219/446.1
8,344,292 B2 * 1/2013 Franca ..... H05B 3/68 219/443.1
8,723,085 B2 5/2014 Callahan et al.
9,132,302 B2 * 9/2015 Luongo ..... A62C 3/006
9,220,130 B1 12/2015 Smith
2016/0010873 A1 1/2016 Palazuelos
2017/0356658 A1 12/2017 Smith et al.
2017/0359861 A1 12/2017 Smith et al.

* cited by examiner

DUAL COIL ELECTRIC HEATING ELEMENT

CROSS REFERENCE TO RELATED APPLICATIONS

This application claims the benefit of U.S. Provisional Patent Application No. 62/506,498, filed May 15, 2017, which is incorporated by reference herein in its entirety.

BACKGROUND

Electric heating elements convert electrical energy to heat energy. Stovetop electric heating elements are susceptible to overheating food and liquid thereby creating hazards, including fire hazards. In addition, manufacturers of stovetop electric heating elements must conform to UL 858 Standard for Household Electric Ranges. Thus, there exists a need to effectively and automatically control the temperature of the food and/or liquid being heated by a stovetop electric heating element to ensure that the food and/or liquid are not heated above a desired temperature limit. There also exists a need to retrofit and/or update existing electric stoves, ranges, and cooktops with electric heating elements that conform to the UL 858 standard. There additionally exists a need to be able to retrofit and/or update existing electric stoves, ranges, and cooktops with improved electric heating elements that do not require any adaptors to enable mounting thereto.

SUMMARY

Disclosed are various embodiments of an electric heating element configured to regulate heat applied to food and liquid being heated or cooked thereon. Also disclosed are various embodiments of an electric heating element configured for mounting to a stove, range, or cooktop and the like either with or without an adaptor.

In one embodiment, an electric heating element of the instant disclosure includes an electrically resistive inner heating element, an electrically resistive outer heating element, one or more temperature sensors positioned along a cold leg of the inner heating element, and a controller. The controller is configured to respond to sensor data from the one or more temperature sensors and selectively control the amount of electrical current provided to the inner heating element while maximum electrical current is provided to the outer heating element.

In another embodiment, an electric heating element includes: (1) an inner coiled surface heating element including first and second cold legs, each of the first and second cold legs comprising first and second electrical conductors extending therefrom, respectively, for connection to an electrical power source, and (2) an outer coiled surface heating element including third and fourth cold legs, each of the third and fourth cold legs comprising third and fourth electrical conductors extending therefrom, respectively, for connection to the electrical power source. The third and fourth cold legs extend parallel to the first and second cold legs from the respective inner and outer coiled surface heating elements and the third and fourth cold legs are positioned adjacent to and above the respective first and second cold legs. The first and second electrical conductors are connected to the third and fourth electrical conductors, respectively. The electric heating element in this embodiment also includes: (3) at least one temperature sensor positioned in proximity to the inner coiled surface heating element and along one of the first, second, third, and fourth cold legs, and (4) a controller comprising a processor and memory, the controller coupled to the temperature sensor and configured to selectively turn on and turn off the inner coiled surface heating element while maintaining the operation of the outer coiled surface heating element.

In another embodiment, an electric heating element includes: an electrically resistive inner heating element, an electrically resistive outer heating element positioned around the inner heating element, and one or more temperature sensors positioned along a cold leg of the inner heating element. The one or more temperature sensors include an electro-mechanical temperature controlling device. During operation, the electrically resistive inner and outer heating elements are energized with electricity to generate heat. Upon sensing a predetermined temperature from the generated heat, the electro-mechanical temperature controlling device opens an electrical circuit to cause the electrically resistive inner heating element to de-energize and cycle off while electricity continues to be delivered to the electrically resistive outer heating element. After a predetermined time has elapsed, or upon sensing a desired change in temperature or a desired lower temperature has been reached due to a reduction in heat generated from the electric heating element, the electro-mechanical temperature controlling device closes the electrical circuit to allow the electrically resistive inner heating element to be cycled on again. The electro-mechanical temperature controlling device is configured to selectively turn on and turn off the electrically resistive inner heating element while maintaining the operation of the electrically resistive outer heating element.

In another embodiment, an electric heating element includes: (1) an inner coiled heating element including first and second cold legs, each of the first and second cold legs comprising first and second electrical conductors extending therefrom, respectively, for connection to an electrical power source, and (2) an outer coiled heating element including third and fourth cold legs, each of the third and fourth cold legs comprising third and fourth electrical conductors extending therefrom, respectively, for connection to the electrical power source. The third and fourth cold legs extend parallel to the first and second cold legs from the respective inner and outer coiled heating elements and the third and fourth cold legs are positioned adjacent to and above the respective first and second cold legs. The first and second electrical conductors are connected to the third and fourth electrical conductors, respectively. The electric heating element in this embodiment also includes a bimetal thermostat configured to selectively allow and interrupt the flow of electricity to the inner coiled heating element while maintaining the operation of the outer coiled heating element. The bimetal thermostat is configured to interrupt the flow of electricity to the inner coiled heating element when the temperature sensed by the bimetal thermostat from heat generated by the electric heating element is at or above a predetermined high temperature, and is configured to restore the flow of electricity to the inner coiled heating element when the temperature sensed by the bimetal thermostat from heat generated by the electric heating element is at or below a predetermined low temperature.

In another embodiment, an electric heating element includes: (1) an electrically resistive inner heating element including an inner coiled heating portion and first and second cold legs extending from the inner coiled heating portion for connection to an electrical power source; (2) an electrically resistive outer heating element including an outer coiled heating portion positioned in a first common plane with and around the inner coiled heating portion, the outer heating element including third and fourth cold legs extending from the outer coiled heating portion for connection to the electrical power source, the third and fourth cold legs positioned parallel to and in a second common plane with the first and second cold legs; and (3) a controller positioned under the first common plane in proximity to the inner coiled heating portion and along one of the first and second cold legs, the controller configured to selectively open and close an electrical circuit to cycle off and on the inner coiled heating portion The controller may be coupled to a timer to enable the controller to open the electrical circuit after a predetermined amount of time has elapsed to turn off the inner coiled heating element while the outer coiled heating element remains energized. The electric heating element may include at least one temperature sensor coupled to the controller to detect a temperature associated with heat emitted from the inner heating element and/or the outer heating element. The controller may include a processor coupled to memory having software thereon that when executed causes the processor to selectively open and close the electrical circuit while the outer coiled heating element is energized. The controller may be configured to dynamically modulate electrical current delivered to the inner coiled heating element.

The controller may be a thermostat configured to selectively open and close the electrical circuit to cycle off and on the inner coiled heating portion while the outer coiled heating element remains energized. The thermostat includes a bimetal material configured to: (a) open the electrical circuit upon detecting a predetermined high temperature associated with heat emitted from the inner heating element and/or the outer heating element, and (b) close the electrical circuit upon detecting a predetermined low temperature associated with heat emitted from the outer heating element.

The electric heating element may include an enclosure for housing the thermostat. The enclosure may comprise a stainless steel. The enclosure may include a first clamshell portion, a second clamshell portion. A seal may be positioned between the first and second clamshells. The enclosure may be black on at least one surface.

The electric heating element may include an enclosure for housing the controller and the at least one temperature sensor. The first common plane is parallel to the second common plane.

In another embodiment, an electric heating element includes: (1) an electrically resistive inner heating element including an inner coiled heating portion and first and second cold legs extending from the inner coiled heating portion for connection to an electrical power source; (2) an electrically resistive outer heating element including an outer coiled heating portion positioned in a common plane with and around the inner coiled heating portion, the outer heating element including third and fourth cold legs extending from the outer coiled heating portion for connection to the electrical power source, the third and fourth cold legs positioned parallel to the first and second cold legs, and (3) an electro-mechanical controlling device positioned under the common plane in proximity to the inner coiled heating portion and along one of the first and second cold legs, the electro-mechanical controlling device configured to selectively open and close an electrical circuit to cycle off and on the inner coiled heating portion.

The electro-mechanical controlling device may include a thermostat. The thermostat may include a bimetal material configured to: (a) open the electrical circuit upon detecting a predetermined high temperature associated with heat emitted from the inner heating element and/or the outer heating element, and (b) close the electrical circuit upon detecting a predetermined low temperature associated with heat emitted from the outer heating element.

The electric heating element may include an enclosure for housing the electro-mechanical controlling device. The third cold leg may be positioned adjacent to and directly above the first cold leg, the fourth cold leg may be positioned adjacent to and directly above the second cold leg, and the third cold leg may be positioned adjacent to and side by side the fourth cold leg. The electric heating element may include a bracket for supporting the first, second, third and fourth cold legs relative to one another, the bracket having an interference fit with the first, second, third, and fourth cold legs. The first, second, third and fourth cold legs may be parallel to the common plane and extend radially past an outermost diameter of the outer coiled heating portion. The electric heating element may include first, second, third, and fourth electrical conductors extending from the first, second, third and fourth cold legs, respectively. The first electrical conductor may be connected or jumpered to the third electrical conductor and the second electrical conductor may be connected or jumpered to the fourth electrical conductor, where the third and fourth electrical conductors may be configured for engaging with an appliance electrical receptacle having a single pair of electrical conductor receiving ports.

In another embodiment, an electric heating element includes: (1) an electrically resistive inner heating element including an inner coiled heating portion and first and second cold legs extending from the inner coiled heating portion for connection to an electrical power source; (2) an electrically resistive outer heating element including an outer coiled heating portion positioned in a common plane with and around the inner coiled heating portion, the outer heating element including third and fourth cold legs extending from the outer coiled heating portion for connection to the electrical power source, wherein the first, second, third and fourth cold legs are parallel to the common plane and extend radially past an outermost diameter of the outer coiled heating portion; (3) first, second, third, and fourth electrical conductors extending from the first, second, third and fourth cold legs, respectively, wherein the first electrical conductor is connected to the third electrical conductor and the second electrical conductor is connected to the fourth electrical conductor, wherein the third and fourth electrical conductors are configured for engaging with an appliance electrical receptacle having a single pair of electrical conductor receiving ports; (4) a thermostat housed in an enclosure under the common plane in proximity to the inner coiled heating portion and along one of the first and second cold legs, the thermostat configured to selectively open and close an electrical circuit to cycle off and on the inner coiled heating portion; and (5) a bracket oriented perpendicularly to the first, second, third, and fourth cold legs and positioned near a terminal end of the first, second, third, and fourth cold legs, the bracket configured to restrain the first, second, third, and fourth cold legs and to separate the first, second, third, and fourth cold legs from one another.

DETAILED DESCRIPTION

Figure 1:
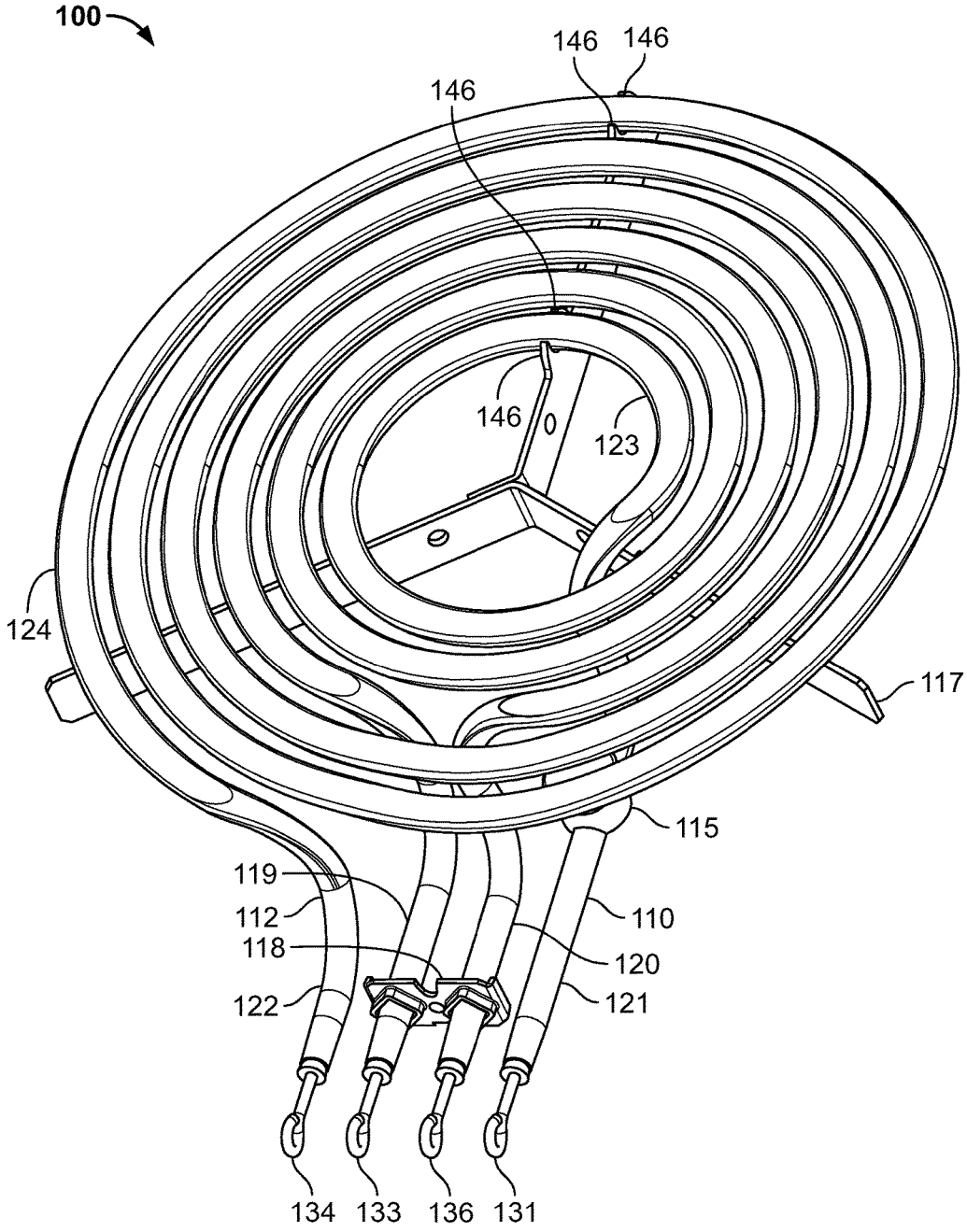
FIG. 1 is a perspective view of an embodiment of an electric heating element of the instant disclosure.

Although the figures and the instant disclosure describe one or more embodiments of a heating element, one of ordinary skill in the art would appreciate that the teachings of the instant disclosure would not be limited to these embodiments. For example, the teachings of the instant disclosure may be applied to controlling the temperature or heat output of any heating element. It should be appreciated that any of the features of an embodiment discussed with reference to the figures herein may be combined with or substituted for features discussed in connection with other embodiments in this disclosure.

Turning now to the figures, wherein like reference numerals refer to like elements, there is shown one or more embodiments of an electric heating element. FIGS. 1-4 illustrate an embodiment of a dual coil electric heating element 100. In this embodiment, heating element 100 includes electrically resistive inner heating element 110, electrically resistive outer heating element 112, one or more temperature sensors 115, spider bracket 117, and terminal bracket 118.

Inner heating element 110 includes cold leg 119, cold leg 121, and coiled portion 123. Outer heating element 112 includes cold leg 120, cold leg 122, and coiled portion 124. The respective cold legs 119,120,121,122 are configured to not generate heat when the respective heating elements 110,112 are electrically energized. The respective coiled portions 123,124 are configured to generate heat when the respective heating elements 110,112 are electrically energized. The respective coiled portions 123,124 of the respective heating elements 110,112 lie in the same plane and in a generally concentric, counterclockwise spiral around a common center. More specifically, the coiled portion 124 of outer heating element 112 lies in a generally concentric, counterclockwise spiral around the coiled portion 123 of the inner heating element 110, and coiled portion 123 of the inner heating element 110 lies in a generally concentric, counterclockwise spiral around a center location that is common to both the outer heating element 112 and the inner heating element 110. In other embodiments, the coiled portions 123,124 may lie in a generally clockwise arrangement.

Figure 2:
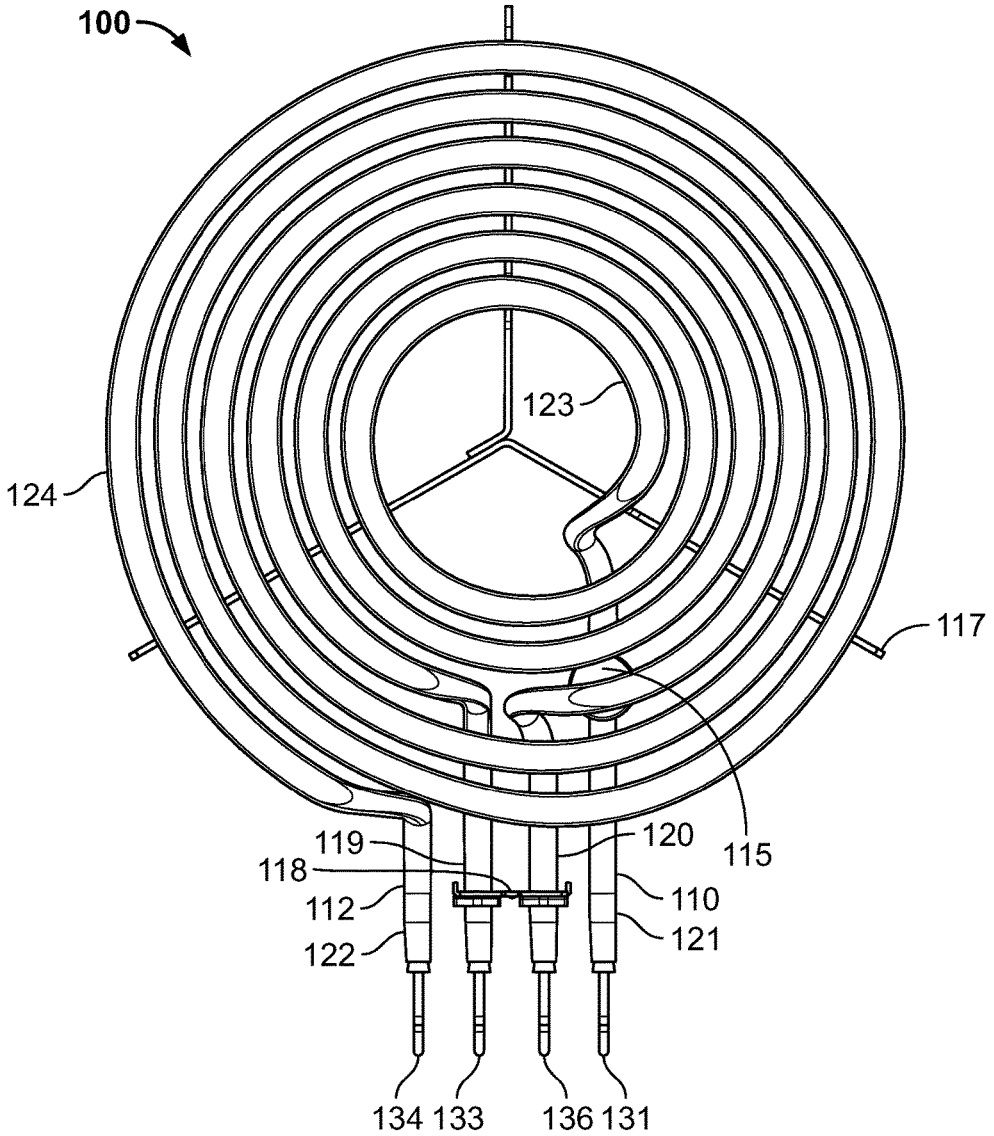
FIG. 2 is a top plan of view of the heating element of FIG. 1.
Figure 3:
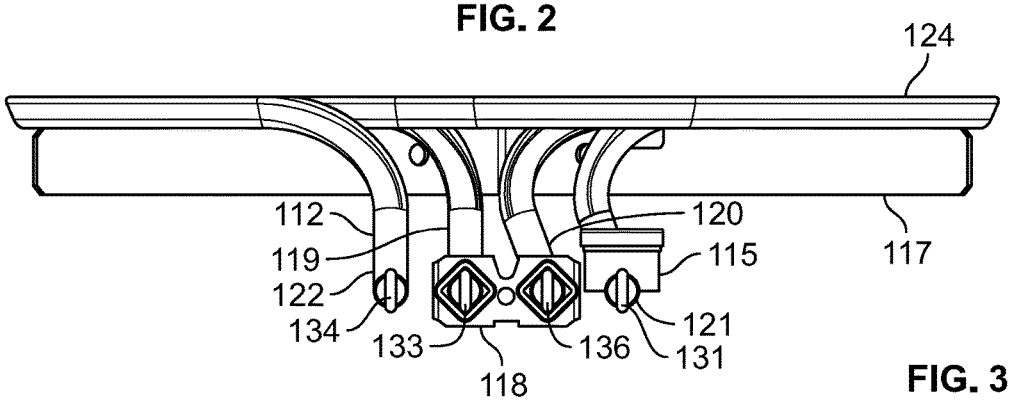
FIG. 3 is a front view of the heating element of FIG. 2.
Figure 4:
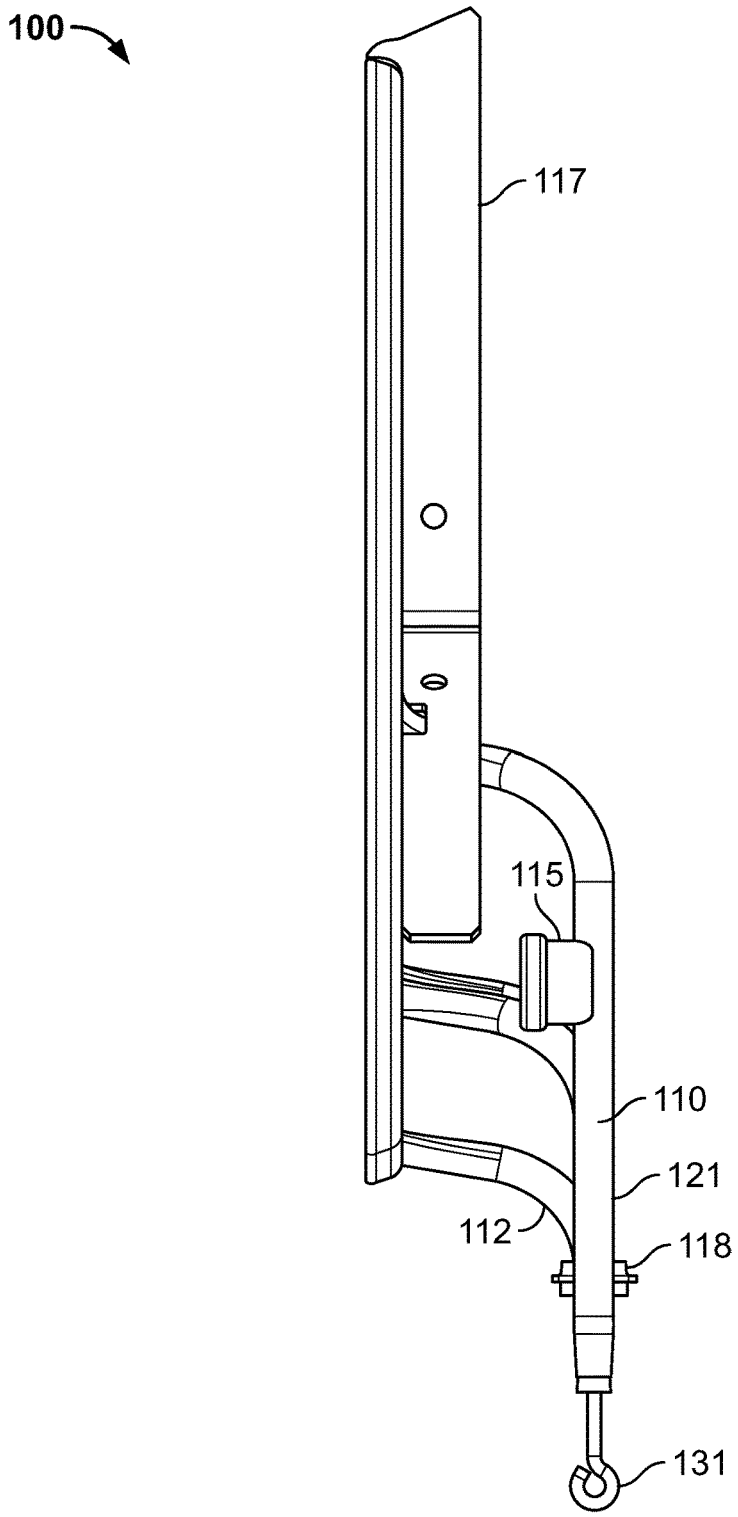
FIG. 4 is a right side view of the heating element of FIG. 2.

To connect heating element 100 to an electrical power source, inner heating element 110 includes electrical terminals 131,133 extending from the end portions of cold legs 121,119, respectively, and outer heating element 112 includes electrical terminals 134,136 extending from the end portions of cold legs 122,120, respectively. As shown in FIGS. 1-3, the terminal/end portion of cold legs 119,120, 121,122 are positioned side by side in approximately the same plane. The side-by-side terminals 131,133,134,136 may be connected to a four-terminal receptacle to connect heating element 100 to an electrical power source. In other embodiments, terminals 131,133,134,136 may be connected to a four-terminal to two-terminal adaptor for connection with conventional two-terminal receptacle stoves, ranges, and cooktops.

Terminal bracket 118 supports at least adjacent cold legs 119,120 and is configured to stabilize the separate inner and outer heating elements 110,112 relative to one another. Terminal bracket 118 may be used to electrically ground electric heating element 100. Terminal bracket 118 may be positioned somewhat near the terminal end of cold legs 119,120 along the sheathed portion of cold legs 119,120. Terminal bracket 118 may include one or more apertures, cutouts, grooves, straps, or other similar features to maintain position of cold legs 119,120. Terminal bracket 118 may be configured to have a close fit or an interference fit with the outer perimeter of cold legs cold legs 119,120. In other embodiments, terminal bracket 118 supports cold legs 119, 120,121,122.

In the embodiment shown in the figures, terminal bracket 118 includes a pair of apertures. The sheathed end of the cold legs 119,120 may be slightly tapered to allow the terminal bracket 118 during assembly to slide onto and wedge against the cold legs 119,120. The apertures in the bracket 118 may be sized to snuggly fit the diameter along any portion of cold legs 119,120 near the terminal end. In other embodiments, the geometry and/or manner of securing bracket 118 to cold legs 119,120 may be different without departing from the scope of the instant disclosure.

Terminal bracket 118 may be configured from an electrically conductive material, such as a metal. Terminal bracket 118 may be configured from a thermally resistant material. Terminal bracket 118 may be used to electrically ground electric heating element 100. Terminal bracket 118 may be formed from a stamping, a forging, a casting, a machined article, a 3-D printed article, or any other suitable manufacturing method.

Spider bracket 117 is configured to support coiled portions 123,124 of the inner and outer heating elements 110,112, respectively, relative to one another. Spider bracket 117 may be configured with three legs arranged at approximately equal angles with respect to one another from a central location, as shown in the figures, or in any other quantity of legs, shape or configuration to support the inner and outer heating elements 110,112.

Heating elements 110,112 may include a tubular sheathed configuration. The cross sectional profile of heating elements 110,112 may include a generally trapezoidal shape with a flat top surface, downwardly sloped and opposed side walls, and a curved bottom wall positioned opposite the flat top surface and joined to the opposed side walls. A relatively small transitional radius may exist between the each of the side walls and the top flat surface. In other embodiments, the cross sectional profile of heating elements 110,112 may have any shape.

Spider bracket 117 may include upwardly extending protrusions 146 on each leg so as to restrain and/or help maintain position of one or more portions of coiled portions 123,124 relative to spider bracket 117. In other embodiments, spider bracket 117 may include recessed receptacles formed in each leg to accomplish this purpose.

One or more temperature sensors 115 may be connected to either or both of heating elements 110,112 for sensing the temperature of a cooking utensil positioned on the top flat surface of heating elements 110,112. To minimize erroneous temperature readings and damage from excessive exposure to heat generated from heating elements 110,112, the one or more temperature sensors 115 may be positioned along cold legs 119,120,121, or 122 (along cold leg 121 of inner heating element 110 is shown). The one or more temperature sensors 115 may include a thermocouple or a thermostat having a relatively small bimetal material, which in turn allows for quicker reset of the switch (discussed below) for improved cooking performance. As discussed more fully below, by positioning one or more temperature sensors 115 along cold leg 121 of inner heating element 110, selective on/off control of the inner coiled portion 123 while maintaining continuous heating of the outer heating element 112 improves cooking performance while minimizing overcooking.

In some embodiments, the one or more temperature sensors 115 comprises a bimetal thermostat positioned along a cold leg, such as cold leg 121 (as shown, for example, in FIG. 4) or along a cold leg 120. The thermostat may selectively control delivery of electrical current to heating element 100. The bimetal material of the thermostat may be configured to open an electrical circuit upon reaching a desired, predetermined temperature thereby shutting off power to inner heating element 110. For example, when a thermostat is positioned along cold leg 121, electrical current to the inner coiled portion 123 is ceased when the bimetal material of the thermostat opens the circuit while electrical current to the outer coiled portion 124 continues at its maximum or other desired setting.

Depending on available space and size of the thermostat and/or thermostat housing and desired responsiveness, a thermostat may be positioned along a cold leg of the outer heating element 112, such as cold leg 120 to provide selective on/off control of the outer coiled portion 124 while maintaining continuous heating of the inner heating element 110. In embodiments when a thermostat is positioned along cold leg 120, for example, electrical current to the outer coiled portion 124 is ceased when the bimetal material of the thermostat opens the circuit while electrical current to the inner coiled portion 123 continues at its maximum or other desired setting.

Upon ceasing the flow of electrical current, the inner heating element 110 (or the outer heating element 112 as the case may be) and the bimetal material of the thermostat will tend to cool due to reduced heat being generated from the heating element 100. When the bimetal material of the thermostat is cooled to a desired, predetermined temperature, the thermostat may "reset" by closing the circuit to allow electricity to flow again to the inner heating element 110. How quickly the thermostat resets and the modulation of heat radiating from heating element 100 may be a function of various factors, including the thermostat size, the configuration and extent of thermostat shielding (e.g., from the housing described below), protective barriers or coatings applied to internal or external surfaces to, for example, thermal shielding (e.g., coating or lining a thermostat housing with a reflective or a nonreflective material or a colored paint), and relative position of the thermostat along a cold leg with respect to the radiant heat from the inner heating element 110 and the outer heating element 112. In some embodiments, a paint or coating may be applied to a surface of the thermostat or to an enclosure housing the thermostat for controlling a rate of exposure of the thermostat to heat from the inner heating element 110 and/or the outer heating element 112. The paint or coating may minimize the potential for overshoot of a desired temperature thereby allowing enhanced responsiveness by the thermostat and quicker reset. In some embodiments, the paint or coating may be black. In other embodiments, the paint or coating may be any other color.

Figure 5:
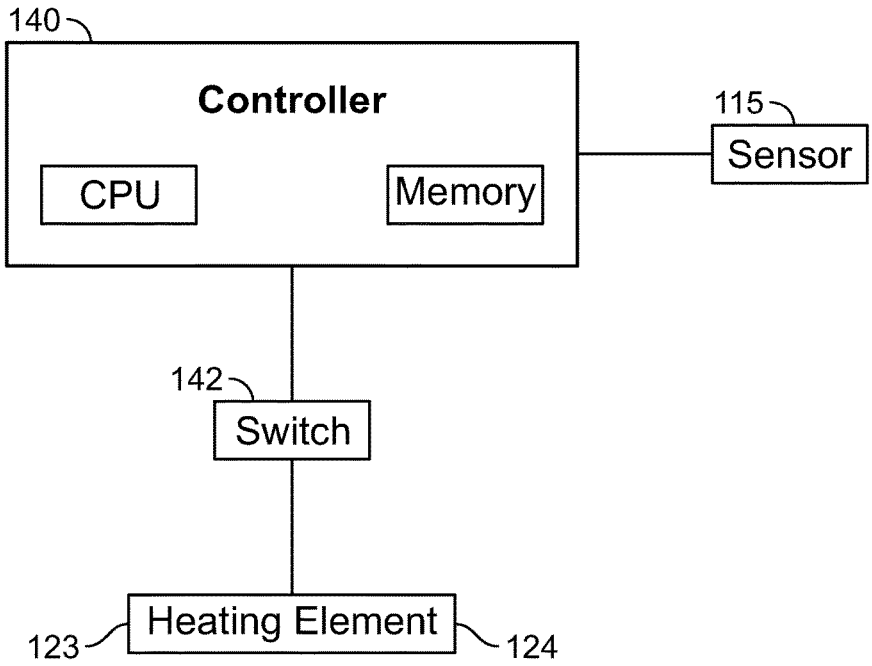
FIG. 5 is a schematic view of a system for operating at least one aspect of an electric heating element of the instant disclosure.
Figure 6:
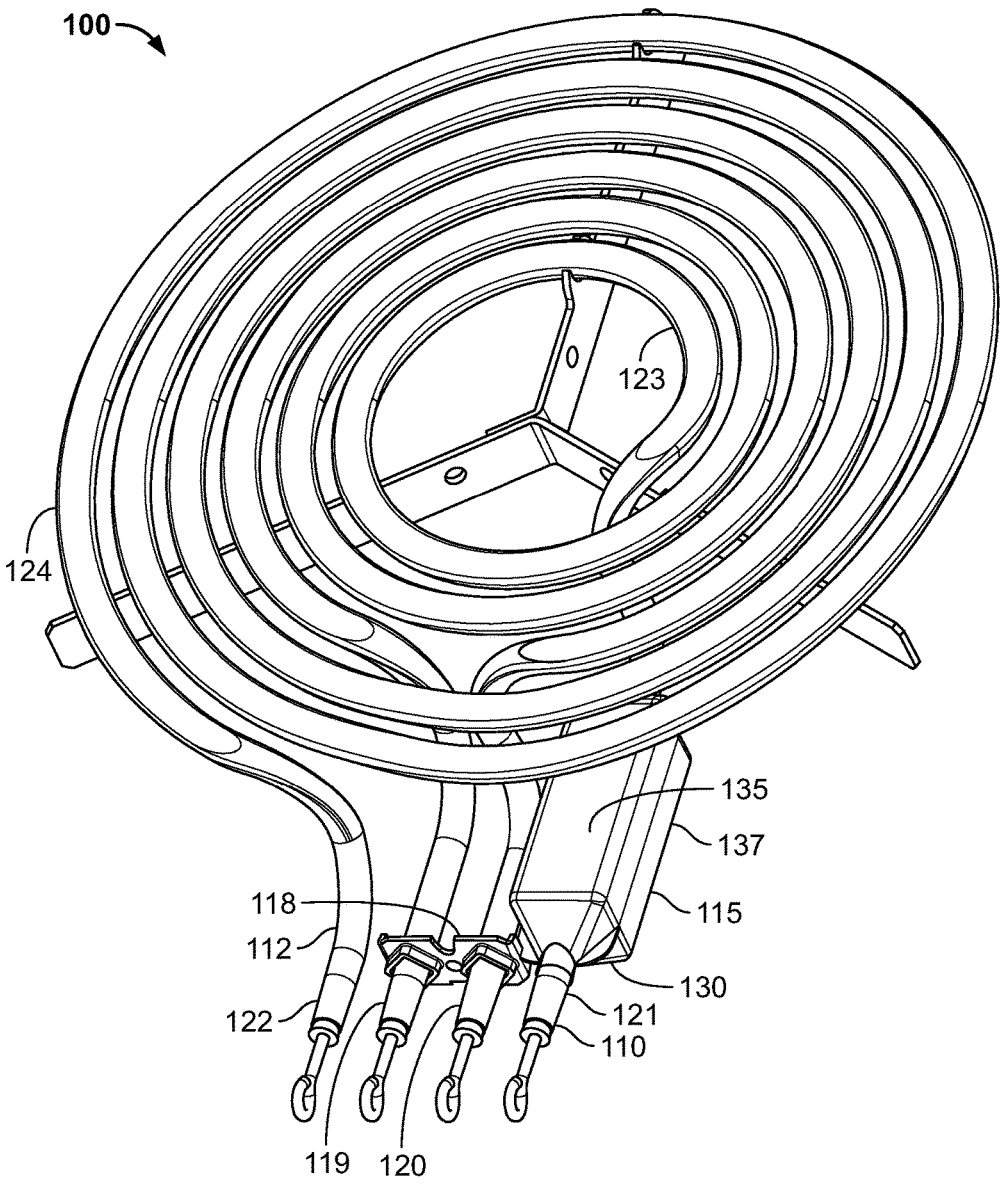
FIG. 6 is a perspective view of another embodiment of an electric heating element of the instant disclosure.
Figure 7:
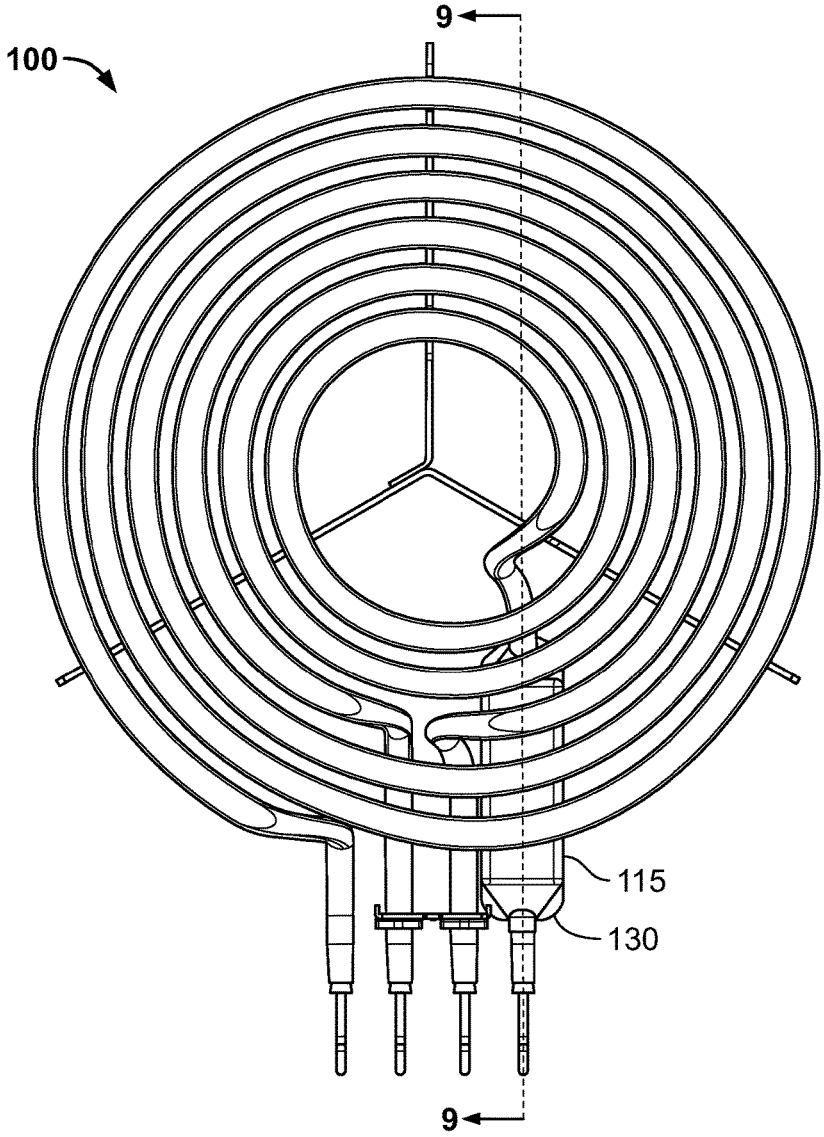
FIG. 7 is a top plan view of the heating element of FIG. 6.
Figure 8:
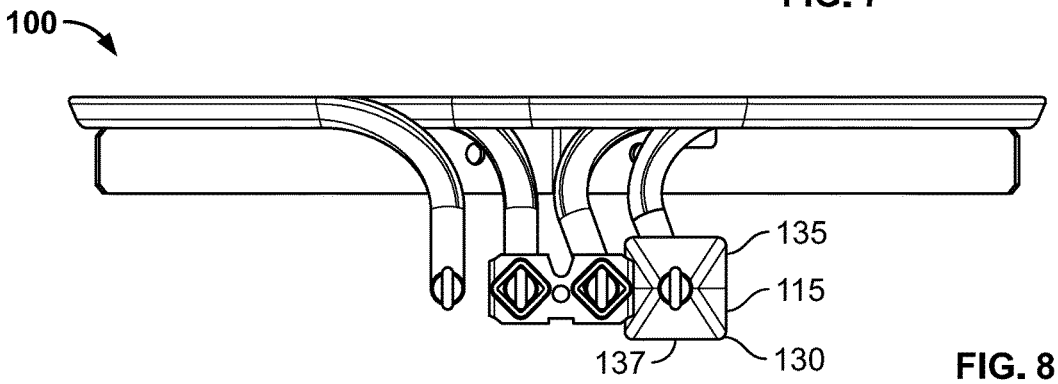
FIG. 8 is a front view of the heating element of FIG. 7.
Figure 9:
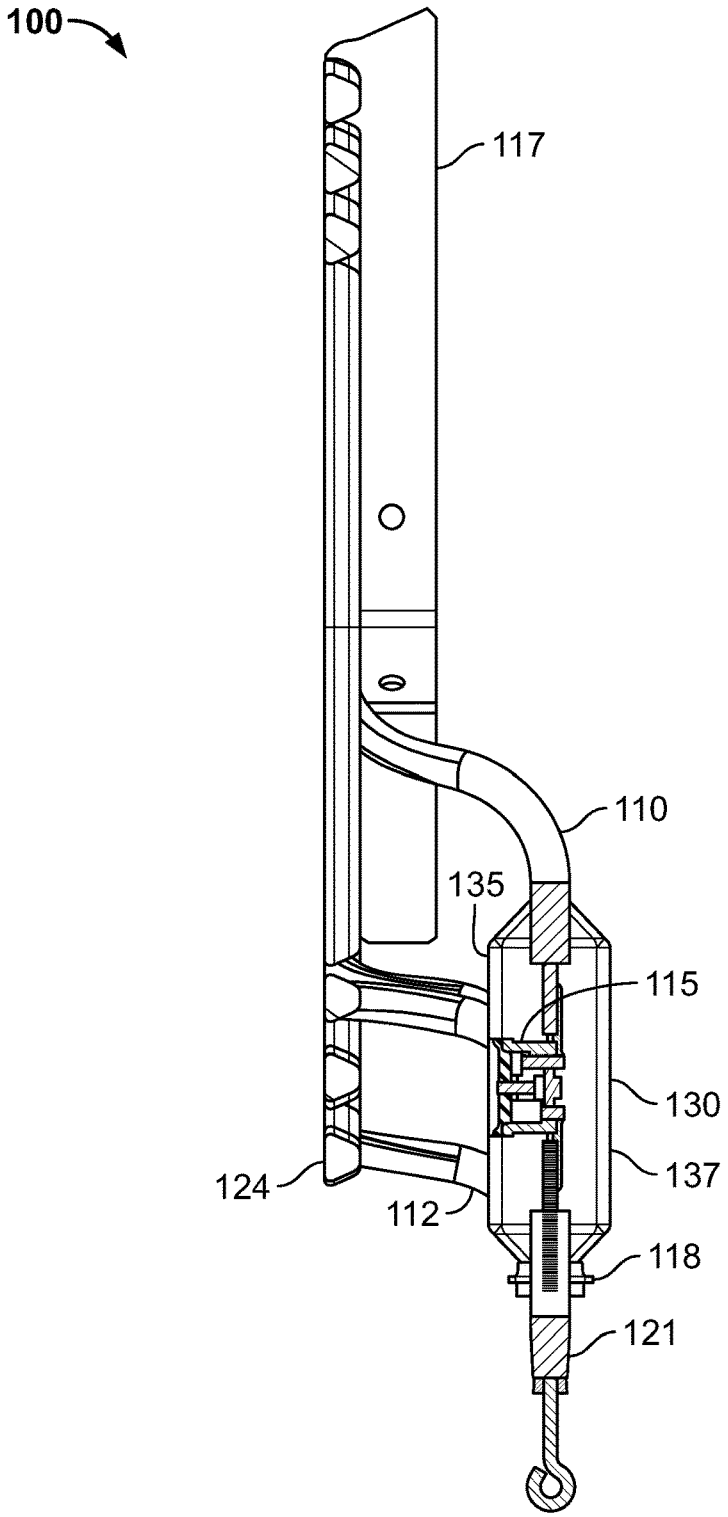
FIG. 9 is a section view of the heating element of FIG. 7 drawn at station A-A.

In other embodiments, the one or more temperature sensors 115 may include or be coupled to an electrical switch 142 (see FIG. 5) to turn on and/or turn off electrical current to a designated inner heating element 110 or an outer heating element 112 or both. A controller 140 comprising a microprocessor and memory may be coupled to the one or more temperature sensors 115 and to the switch 142, and upon receiving a signal and/or sensor data from the one or more temperature sensors 115, may command the switch 142 to open and/or close to turn on and/or turn off electrical current to a designated inner heating element 110 or an outer heating element 112 or both. The signal and/or sensor data may be a sensed temperature or interpreted as a sensed temperature by the controller 140. In some embodiments, the controller 140 may command the switch 142 to open and/or close to turn on and/or turn off electrical current to a designated inner heating element 110 or an outer heating element 112 or both irrespective of any sensor data received from the one or more temperature sensors 115. The controller 140 may be configured to interpret temperature gradients sensed or measured over a period of time. The controller 140 may be configured to open and/or close the switch in advance of actually reaching a predetermined temperature according to the temperature gradient to ensure, for example, a predetermined maximum temperature of the cooking utensil and/or to ensure maintaining an optimum mean operating temperature of the heating element 100 according to the item being heated or cooked thereon.

In some embodiments, in response to sensor data received from the one or more temperature sensors 115, the controller 140 may be configured to dynamically modulate the flow of electrical current to, and thus heat output from, a designated inner heating element 110 or outer heating element 112 or both.

The controller 140 may include preprogrammed logic to automatically control the temperature of the cooking utensil and/or the item being heated or cooked therein after the user sets the heating element 100 to its maximum "on" position thereby energizing both the inner and the outer coiled portions 123,124. The controller 140 may be programmed to selectively control delivery of electrical current to heating element 100. For example, in some embodiments, electrical current to the inner coiled portion 123 is ceased while electrical current to the outer coiled portion 124 continues at its maximum setting. In other embodiments, electrical current to the outer coiled portion 124 is ceased while electrical current to the inner coiled portion 123 continues at its maximum setting.

In various embodiments, when a predetermined temperature of the cooking utensil is reached, as sensed by the one or more temperature sensors 115 and/or interpreted by the controller 140, the controller 140 may command the switch 142 to open to cease the flow of electrical current to one of the inner coiled portion 123 or the outer coiled portion 124 for a predetermined period of time, until a predetermined change in temperature is sensed by the one or more temperature sensors 115, or until a predetermined lower temperature is sensed by the one or more temperature sensors 115.

When either the predetermined period of time has elapsed, the predetermined change in temperature is sensed, or the predetermined lower temperature is sensed, the controller 140 may command the switch 142 to close so to reinstate the flow of electrical current to the coiled portion 123 or 124 that was earlier ceased. The time at which the controller 140, via the switch 142, turns off the flow of electrical current and reinstates the flow of electrical current to an affected inner or outer coiled portion 123,124 may be affected by how quickly the change in temperature of the cooking utensil reaches the one or more temperature sensors 115 that results from the change in electrical current. Factors that may influence the timing for opening and closing the switch include the proximity of the one or more temperature sensors 115 to the cooking utensil and whether a thermal insulator or a thermal conductor or both is positioned between the one or more temperature sensors 115 and the cooking utensil. The timing may be calibrated to account for these and other factors to maximize the performance of the heating element 100.

The controller 140 described herein may include and/or be connected to one or more CPU's, memory, data buses, switches, sensors, displays, user interfaces, and software configured to respond to and/or carry out computer commands.

FIGS. 6-9 illustrate an embodiment of a dual coil electric heating element 100 shown with a protective housing 130 for housing and protecting temperature sensor 115 from dust, debris, food, liquids, and excessive or undesirable temperatures, and for enabling optimum performance of temperature sensor 115 in a smaller package. In some embodiments, housing 130 may be configured to house one or more temperature sensors 115. Housing 130 protects the temperature sensor 115 from exposure to liquids and excessive heat. Housing 130 may include a clamshell configuration with a clamshell seam generally lying in a horizontal plane. In this configuration, housing 130 may include upper shell portion 135 and lower shell portion 137 that may be laser welded and/or crimped together to house one or more temperature sensors 115 to provide a design simplicity and smaller/lower profile of the upper shell portion 135, and fewer points of entry for liquids as may occur during immersion of heating element 100 in soap and water during cleaning. In other embodiments, the clamshell configuration of housing 130 may be oriented side-to-side such that the clamshell seam generally lies in vertical plane and the clamshell includes a right shell portion and a left shell portion instead of upper shell portion 135 and lower shell portion 137.

In the embodiment shown in the figures, at least upper shell portion 135 may be made from a thermally conductive material, such as a stainless steel, which enables excellent coupling and robust adhesion of the cap/cup of the temperature sensor 115 to the upper shell portion 135. Lower shell portion 137 may also be made from a thermally conductive material, such as a stainless steel, to provide an improved heat sink for the upper shell portion 135 and a faster switch reset, thus enabling improved cooking performance or use of a clad metal to achieve the same function. In addition, use of a thermally conductive material for housing 130 helps to ensure heat transfer to and from the temperature sensor 115, resulting in faster response to both heating and cooling cycles.

To control or enhance the amount or rate of heat transfer or otherwise enhance the performance of temperature sensor 115, housing 130 may also include one or more coatings, as described above. For example, housing 130 may include a coating applied to internal or external surfaces to, for example, upper shell portion 135, lower shell portion 137, or both. The coating may be applied to one or more surfaces of housing 130 in a manner or orientation that helps ensure quick reset by the one or more temperature sensors 115. As described above, the coating may be in the form of paint, such as paint in the color black or any other suitable color, which may be configured to induce heat transfer of heat radiated from electric heating element 100. In other embodiments, the coating may be applied to a surface of the one or more temperature sensors 115 to control or enhance the amount or rate of exposure of the one or more temperature sensors 115 to heat from the inner heating element 110 and/or the outer heating element 112. In this way, the potential for overshoot of a desired temperature may be minimized, thereby allowing enhanced responsiveness by the thermostat and quicker reset.

Housing 130 may include one or more ribs to provide increased housing rigidity while allowing for reduced thermal mass by allowing thinner wall thickness of the housing 130. For example, either or both of upper shell portion 135 and lower shell portion 137 may include ribs positioned on an inner surface of upper shell portion 135 and/or lower shell portion 137 to provide rigidity to the respective upper and lower shell portions while minimizing the wall thickness of the respective shell portions to maximize heat transfer through the respective shell portions.

Laser welded housing 130 coupled with resistance (spot) welding of a cold pin to the temperature sensor 115 enables the use of a very short weld tab/cold pin configuration and a proportional reduction in the size of the housing 130. The relatively small size of housing 130 enables placement of the one or more temperature sensors 115 in close proximity to the heated coil portions 123,124 of the heating element 100 and above the drip pan that normally lies below the heating element on a stovetop or similar apparatus, thereby providing easy interchangeability with conventionally designed heating elements that lack the one or more temperature sensors 115. In some embodiments, the one or more temperature sensors 115 may be a bimetal thermostat operable as described above.

In some embodiments, controller 140, switch 142, and the one or more temperature sensors 115 may be housed in housing 130. In other embodiments, the controller 140 and/or switch 142 are positioned upstream of electrical terminals 131,133,134,136. The one or more temperature sensors 115 may be configured to perform the tasks of sensing temperature and also acting as the switch 142.

FIGS. 10-14 illustrate an embodiment of a dual coil electric heating element 150 having a compact terminal portion 155 that enables easy interchangeability for conventional heating elements having a conventional, two-terminal design. To enable adaptor-free installation into conventional twin-terminal receptacles, which would be required if the electric heating element is configured with four terminals like that shown in FIGS. 1-9, compact terminal portion 155 of electric heating element 150 conveniently bundles respective inner and outer positive and negative terminals together to form a single pair of terminals for insertion into a conventional two-terminal heating element receptacle. This embodiment may have some or all of the same features as described above to obtain precise temperature control of the cooking utensil and/or the item being heated or cooked therein. For example, in this embodiment, heating element 150 includes electrically resistive inner heating element 160, electrically resistive outer heating element 162, one or more temperature sensors 165, spider bracket 167, and terminal bracket 168 in addition to compact terminal portion 155.

Inner heating element 160 includes cold leg 169, cold leg 171, and coiled portion 173. Outer heating element 162 includes cold leg 170, cold leg 172, and coiled portion 174. The respective cold legs 169,170,171,172 are configured to not generate heat when the respective heating elements 160,162 are electrically energized. The respective coiled portions 173,174 are configured to generate heat when the respective heating elements 160,162 are electrically energized. The respective coiled portions 173,174 of the respective heating elements 160,162 lie in the same plane and in a generally concentric, counterclockwise spiral around a common center. More specifically, the coiled portion 174 of outer heating element 162 lies in a generally concentric, counterclockwise spiral around the coiled portion 173 of the inner heating element 160, and coiled portion 173 of the inner heating element 160 lies in a generally concentric, counterclockwise spiral around a center location that is common to both the outer heating element 162 and the inner heating element 160. In other embodiments, the coiled portions 173,174 may lie in a generally clockwise arrangement.

As shown in the figures, the end portions of cold legs 169,170,171,172 are arranged on top of one another and adjacent one another in a nested and compact arrangement from which a pair of terminals 184,186 extend for connecting to an electrical power source. More specifically, the end portion of cold leg 169 of inner heating element 160 is positioned beneath the end portion of cold leg 172 of outer heating element 162, and the end portion of cold leg 171 of inner heating element 160 is positioned beneath the end portion of cold leg 170 of outer heating element 162. The end portion of cold leg 169 is positioned adjacent to and side by side with the end portion of cold leg 171, and the end portion of cold leg 172 is positioned adjacent to and side by side with the end portion of cold leg 170.

Figure 14:
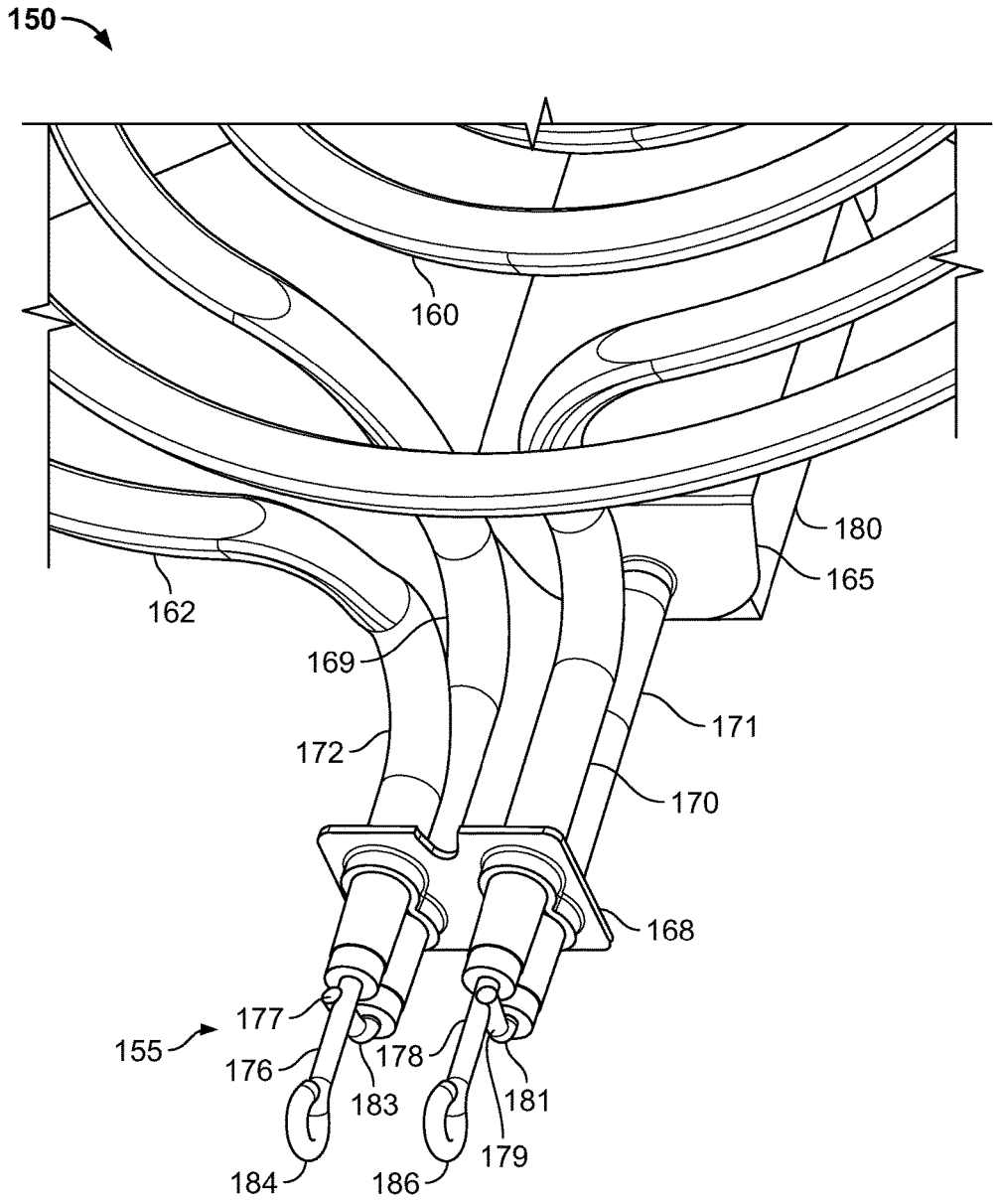
FIG. 14 is a partial perspective view of a portion of the heating element of FIG. 10.
Figure 15:
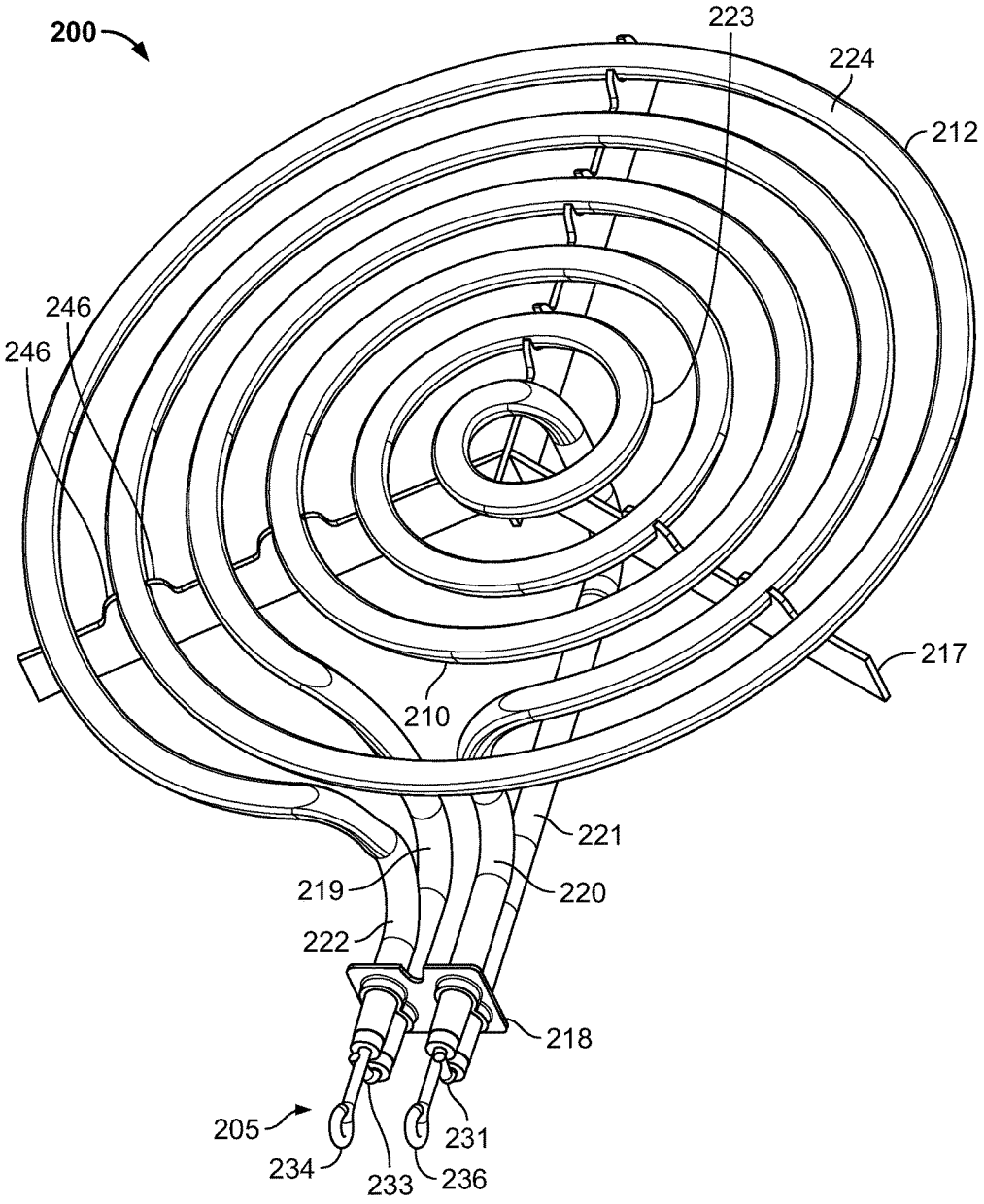
FIG. 15 is a perspective view of an embodiment of another heating element of the instant disclosure.
Figure 16:
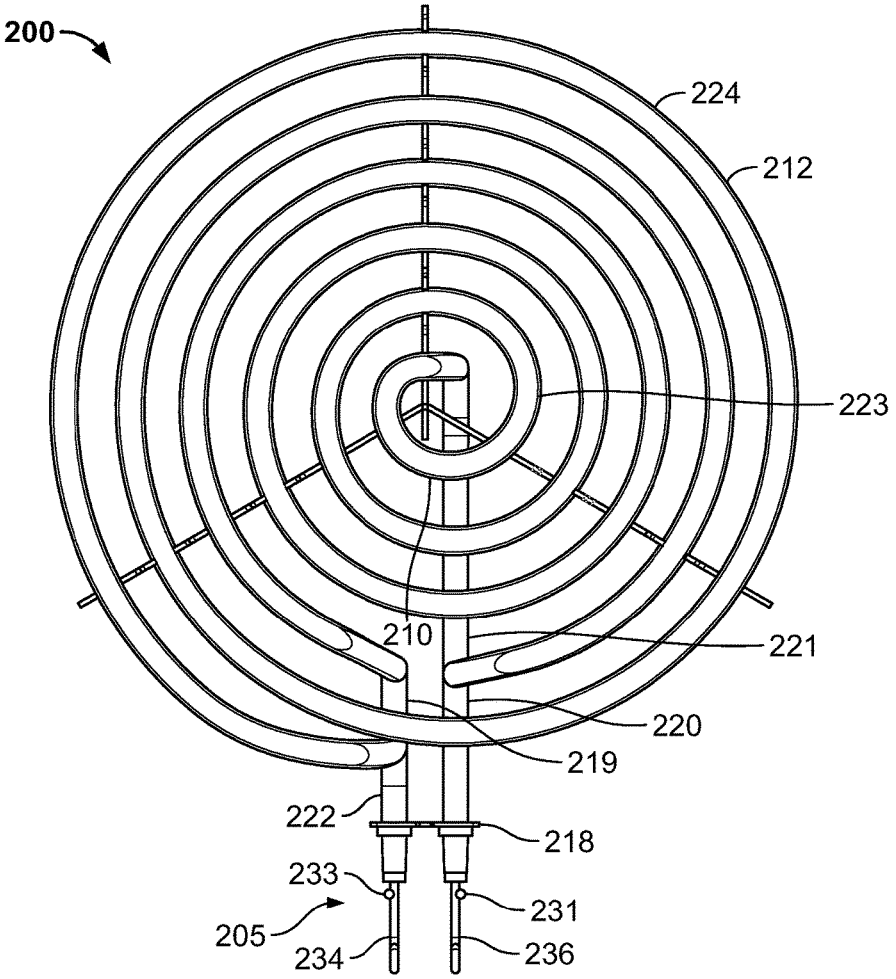
FIG. 16 is a top view of the heating element of FIG. 15.
Figure 17:
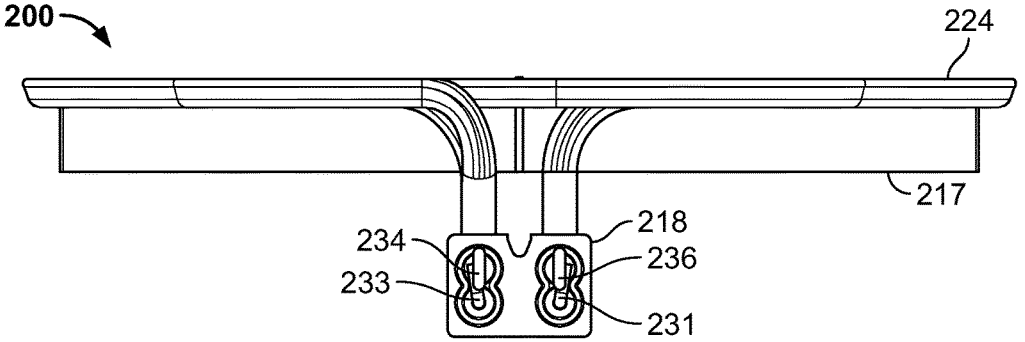
FIG. 17 is a front view of the heating element of FIG. 15.
Figure 18:
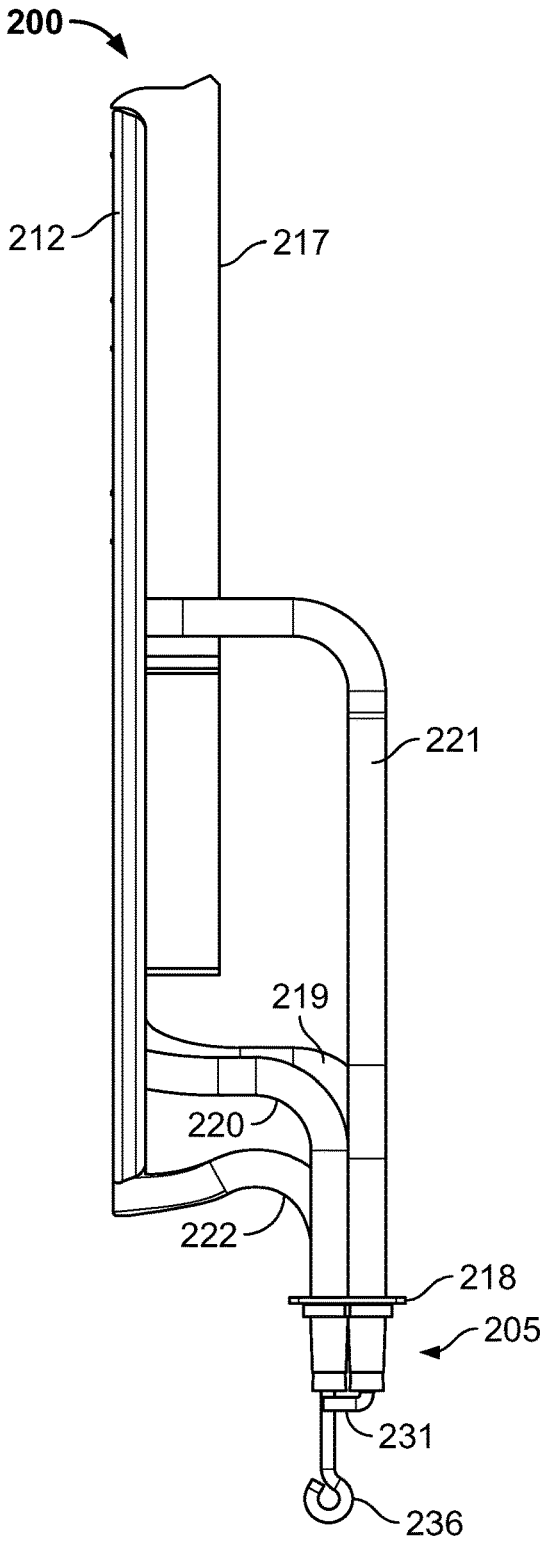
FIG. 18 a right side view of the heating element of FIG. 15.
Figure 19:
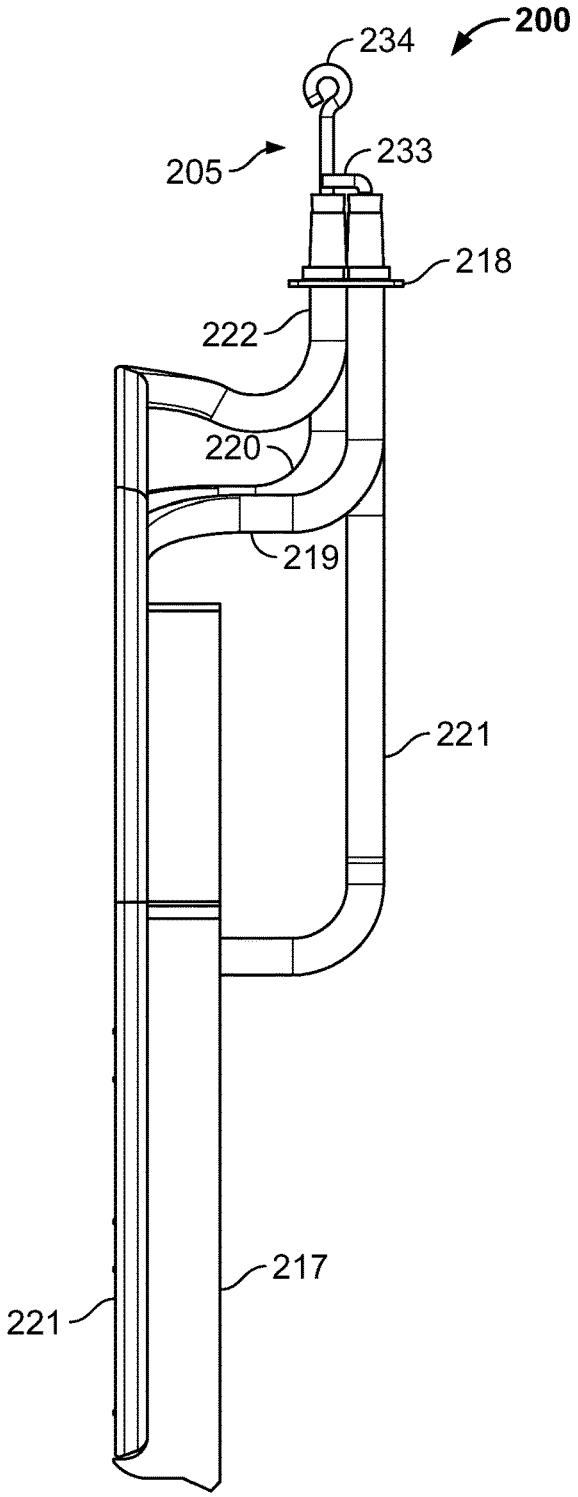
FIG. 19 a left side view of the heating element of FIG. 15.

To connect heating element 150 to an electrical power source, inner heating element 160 includes electrical terminals 181,183 extending from the end portions of cold legs 171,169, respectively, and outer heating element 162 includes electrical terminals 184,186 extending from the end portions of cold legs 172,170, respectively. As best shown in FIG. 14, terminal 181 is connected to terminal 186 and terminal 183 is connected to terminal 184. In this embodiment, the electrical conductor 179 of terminal 181 is bent upwardly and soldered or brazed to, or otherwise joined with, the electrical conductor 178 of terminal 186 at a location some distance away from the end of terminal 186. Similarly, the electrical conductor 177 of terminal 183 is bent upwardly and soldered or brazed to, or otherwise joined with, the electrical conductor 176 of terminal 184 at a location some distance away from the end of terminal 184. In other embodiments, terminals 181 and 183 may be jumpered to terminals 186 and 184, respectively. Positioning and connecting the conductors 177 and 179 to conductors 176 and 178, respectively, allows for direct connection of terminals 184 and 186 to an electrical power source on a conventional two-terminal receptacle stovetop, cooktop, or range appliance without requiring a 4 terminal-to-2-terminal receptacle adaptor.

Terminal bracket 168 supports respective cold legs 169, 170,171,172 and is configured to stabilize the inner and outer heating elements 160,162 relative to one another. Terminal bracket 168 may be used to electrically ground electric heating element 150. Spider bracket 167 is configured to support coiled portions 173,174 of the inner and outer heating elements 160,162, respectively, relative to one another. Spider bracket 167 may be configured with three legs arranged at approximately equal angles with respect to one another from a central location, as shown in the figures, or in any other quantity of legs, shape or configuration to support the inner and outer heating elements 160,162. Spider bracket 167 may include upwardly extending protrusions 196 on each leg so as to restrain and/or help maintain position of one or more portions of coiled portions 173,174 relative to spider bracket 167. In other embodiments, spider bracket 167 may include recessed receptacles formed in each leg to accomplish this purpose.

Heating elements 160,162 may include a tubular sheathed configuration. The cross sectional profile of heating elements 160,162 may include a generally trapezoidal shape with a flat top surface, downwardly sloped and opposed side walls, and a curved bottom wall positioned opposite the flat top surface and joined to the opposed side walls. A relatively small transitional radius may exist between the each of the side walls and the top flat surface. In other embodiments, the cross sectional profile of heating elements 160,162 may have any shape.

One or more temperature sensors 165 may be connected to either or both of heating elements 160,162 for sensing the temperature of a cooking utensil positioned on the top flat surface of heating elements 160,162. To minimize erroneous temperature readings and damage from excessive exposure to heat generated from heating elements 160,162, the one or more temperature sensors 165 may be positioned along cold legs 169,170,171,172 (along cold leg 171 of inner heating element 160 is shown). The one or more temperature sensors 165 may include a thermocouple or a relatively small thermostat having a relatively small bimetal material, which in turn allows for quicker reset of the switch (discussed below) for improved cooking performance. By positioning one or more temperature sensors 165 along cold leg 171 of inner heating element 160, selective on/off control of the inner coiled portion 173 while maintaining continuous heating of the outer heating element 162 improves cooking performance while minimizing overcooking.

Figure 13:
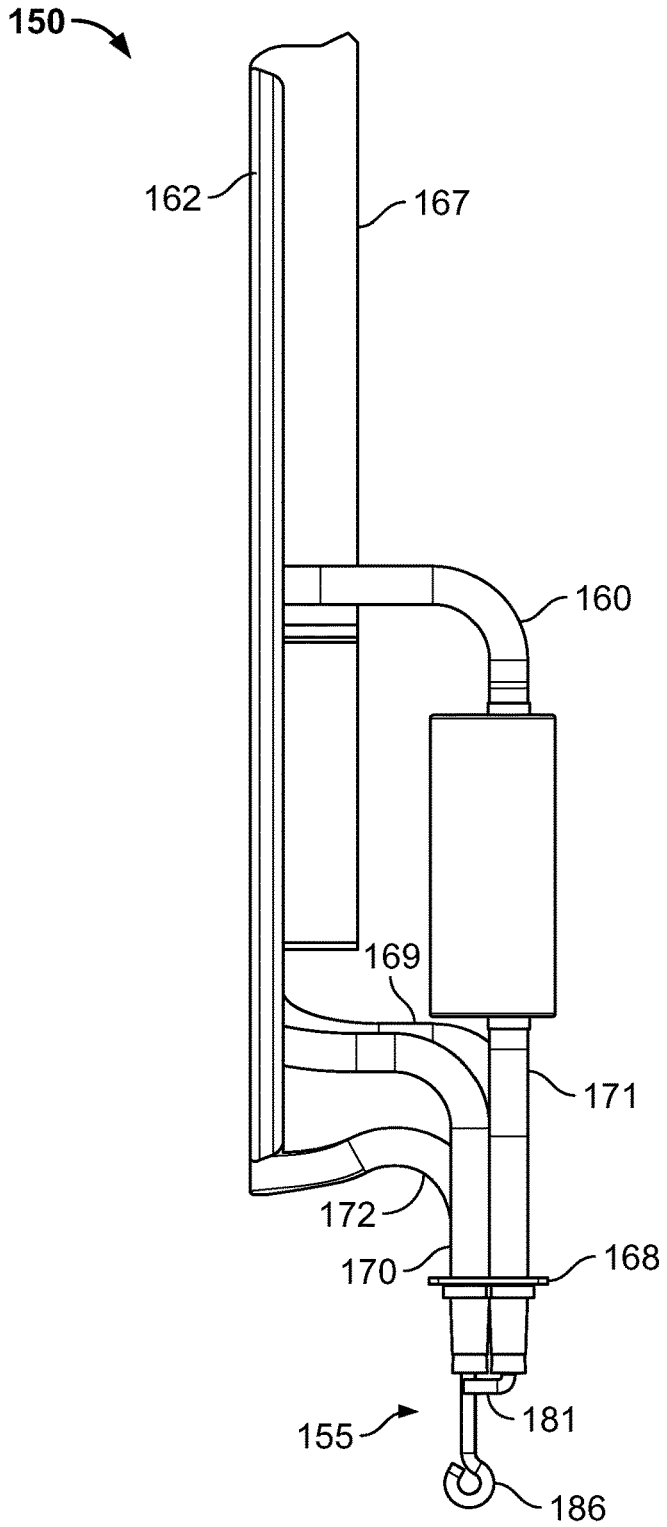
FIG. 13 a right side view of the heating element of FIG. 10.

In some embodiments, the one or more temperature sensors 165 comprises a bimetal thermostat positioned along a cold leg, such as cold leg 171 (as shown, for example, in FIG. 13). The thermostat may selectively control delivery of electrical current to heating element 200. The bimetal material of the thermostat may be configured to open an electrical circuit upon reaching a desired, predetermined temperature thereby shutting off power to inner heating element 160. For example, when a thermostat is positioned along cold leg 171, electrical current to the inner coiled portion 173 is ceased when the bimetal material of the thermostat opens the circuit while electrical current to the outer coiled portion 174 continues at its maximum or other desired setting.

Depending on available space and size of the thermostat and/or thermostat housing, a thermostat may be positioned along a cold leg of the outer heating element 162, such as cold leg 170 to provide selective on/off control of the outer coiled portion 174 while maintaining continuous heating of the inner heating element 160. In embodiments when a thermostat is positioned along cold leg 170, for example, electrical current to the outer coiled portion 174 is ceased when the bimetal material of the thermostat opens the circuit while electrical current to the inner coiled portion 173 continues at its maximum or other desired setting.

Upon ceasing the flow of electrical current, the inner heating element 160 (or the outer heating element 162 as the case may be) and the bimetal material of the thermostat will tend to cool due to reduced heat being generated from the heating element 150. When the bimetal material of the thermostat is cooled to a desired, predetermined temperature, the thermostat may "reset" by closing the circuit to allow electricity to flow again to the inner heating element 160. How quickly the thermostat resets and the modulation of heat radiating from heating element 200 may be a function of various factors, including the thermostat size, the configuration and extent of thermostat shielding (e.g., from the housing described below), protective barriers or coatings applied to internal or external surfaces to, for example, thermal shielding (e.g., coating or lining a thermostat housing with a reflective or a nonreflective material or a colored paint), and relative position of the thermostat along a cold leg with respect to the radiant heat from the inner heating element 160 and the outer heating element 162. As described above, some embodiments may include a paint or a coating applied to a surface of the thermostat or to a surface of the enclosure that houses the thermostat, such as housing 180, to control the amount or the rate of exposure of the thermostat to heat from the inner heating element 160 and/or the outer heating element 162.

In other embodiments, the one or more temperature sensors 165 may include or be coupled to an electrical switch, such as switch 142 described above to turn on and/or turn off electrical current to a designated inner heating element 160 or outer heating element 162 or both. A controller 140 comprising a microprocessor and memory may be coupled to the one or more temperature sensors 165 and to the switch 142, and upon receiving a signal and/or sensor data from the one or more temperature sensors 165, may command the switch 142 to open and/or close to turn on and/or turn off electrical current to a designated inner heating element 160 or outer heating element 162 or both. The signal and/or sensor data may be a sensed temperature or interpreted as a sensed temperature by the controller 140. The features and functionality of controller 140 with respect to the operation of electric heating element 150 may be the same as described above for electric heating element 100.

Electric heating element 150 may include a protective housing 180 for housing and protecting the one or more temperature sensors 165 from dust, debris, food, liquids, and excessive or undesirable temperatures, and for enabling optimum performance of the one or more temperature sensors 165 in a smaller package. In some embodiments, housing 180 may be configured to house one or more temperature sensors 165. Housing 180 may have all of the same features as housing 130 described above.

Figure 10:
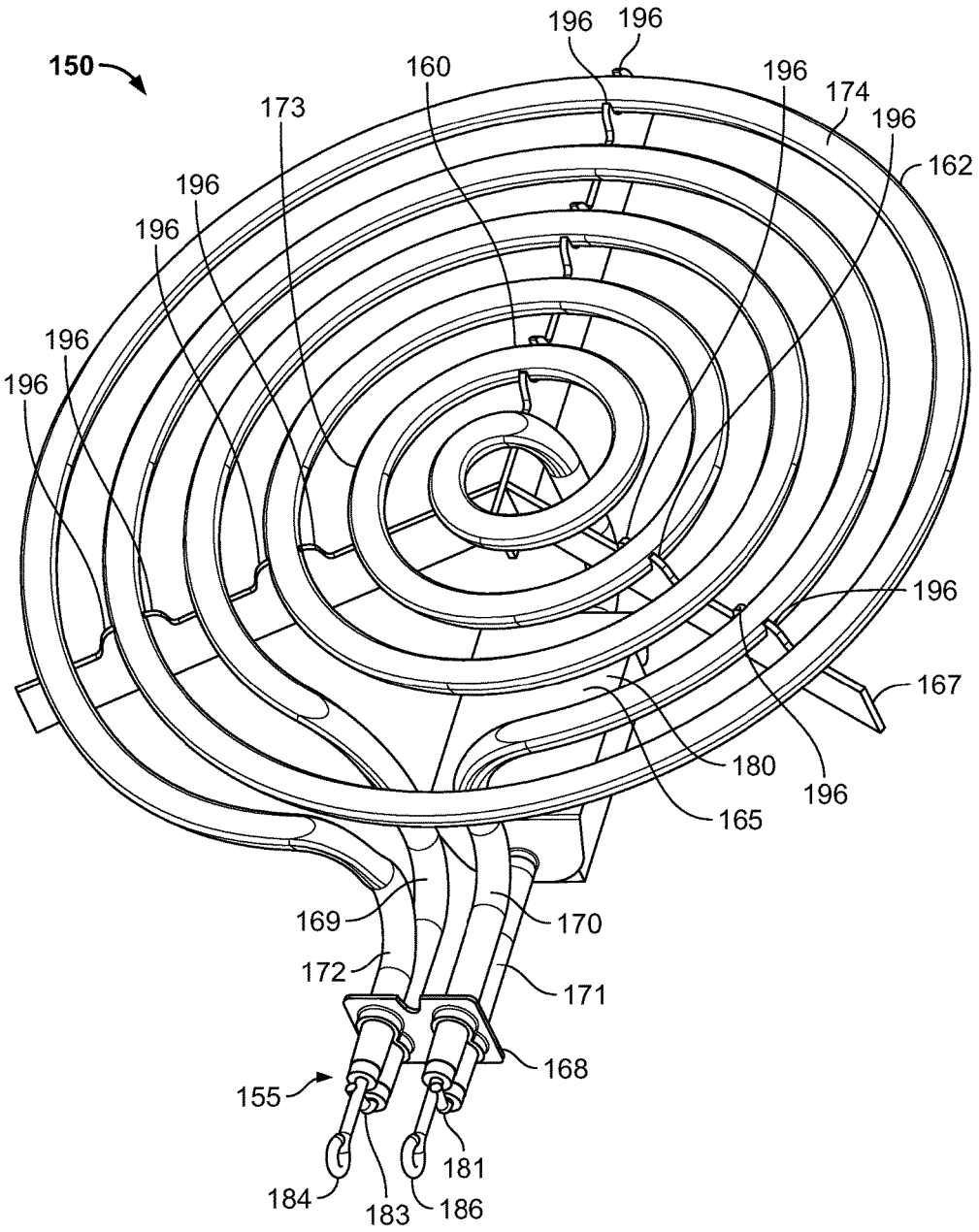
FIG. 10 is a perspective view of an embodiment of another heating element of the instant disclosure.
Figure 11:
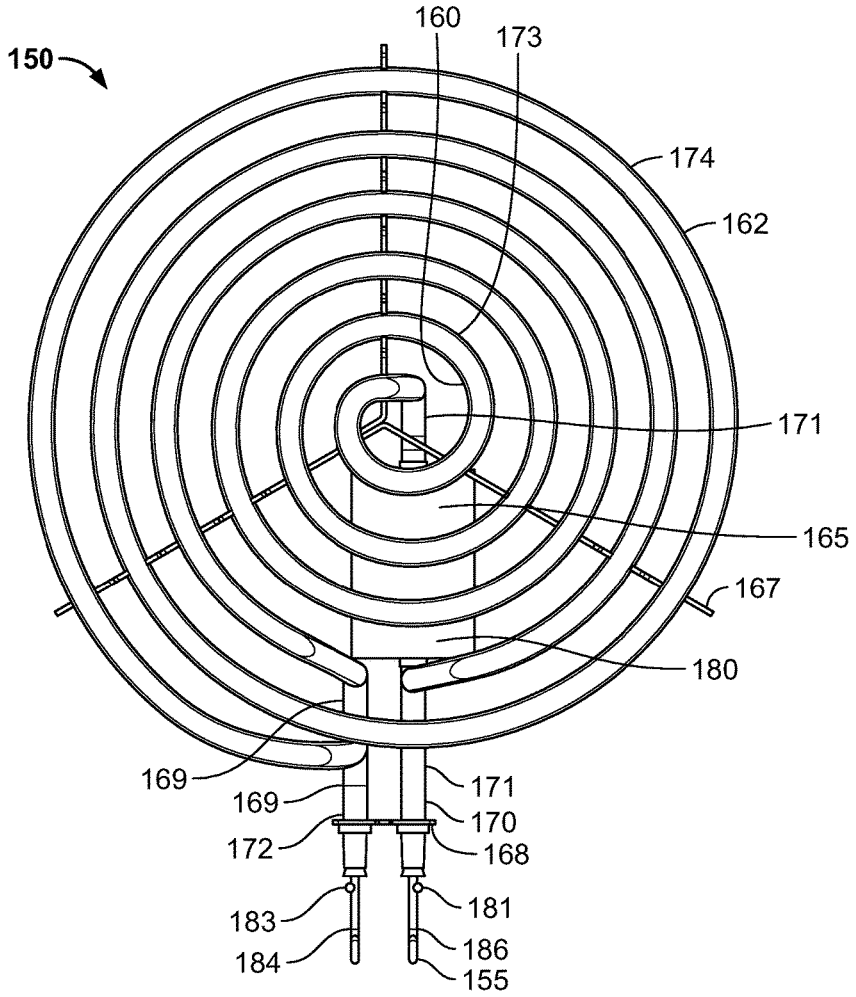
FIG. 11 is a top view of the heating element of FIG. 10.
Figure 12:
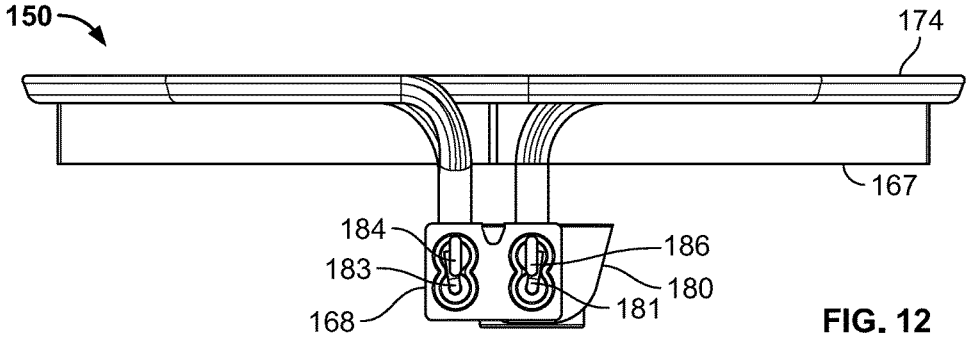
FIG. 12 is a front view of the heating element of FIG. 10.

In one embodiment, as best shown in FIGS. 10 and 12, the one or more temperature sensors 165 and its protective housing 180 (or 130 as the case may be) are positioned along the cold leg 171 and underneath the inner coiled portion 173 and the outer coiled portion 174. A first end of cold leg 171 extends from the housing 180 and terminates at terminal 186 via terminal 181 and conductors 179,178. A second end of cold leg 171 extends from housing 180 toward the center of the electric heating element 150 below one leg of spider bracket 167. The second end turns upwardly after exiting housing 180 and then turns horizontally to transition to inner coiled portion 173 of inner heating element 160. This arrangement permits a relatively small radius for the first counterclockwise turn of inner coiled portion 173 of inner heating element 160, which minimizes the size of any unheated area in the center portion of electric heating element 150. As described above, the one or more temperature sensors, whether or not housed in an enclosure, such as housing 180, may be positioned above the drip pan that normally lies below the heating element on a stovetop or similar apparatus.

FIGS. 15-20 illustrate an embodiment of a dual coil electric heating element 200 without a temperature sensor but including electrically resistive inner heating element 210, electrically resistive outer heating element 212, spider bracket 217, terminal bracket 218, and compact terminal portion 205. Each of these components may have the same features or attributes as described in any of the embodiments described herein. For example, compact terminal portion 205 may have the same features or attributes as compact terminal portion 155. This configuration enables easy interchangeability with conventional heating elements having a twin-terminal design while providing the advantage of increased wattage over a conventional, single coil electric heating element. To enable adaptor-free installation into conventional twin-terminal receptacles, which would be required if the electric heating element is configured with four terminals like that shown in FIGS. 1-9, compact terminal portion 205 of electric heating element 200 conveniently bundles respective inner and outer positive and negative terminals together to form a single pair of terminals for insertion into a conventional two-terminal heating element receptacle.

Inner heating element 210 includes cold leg 219, cold leg 221, and coiled portion 223. Outer heating element 212 includes cold leg 220, cold leg 222, and coiled portion 224. The respective cold legs 219,220,221,222 are configured to not generate heat when the respective heating elements 210,212 are electrically energized. The respective coiled portions 223,224 are configured to generate heat when the respective heating elements 210,212 are electrically energized. The respective coiled portions 223,224 of the respective heating elements 210,212 lie in the same plane and in a generally concentric, counterclockwise spiral around a common center. More specifically, the coiled portion 224 of outer heating element 212 lies in a generally concentric, counterclockwise spiral around the coiled portion 223 of the inner heating element 210, and coiled portion 223 of the inner heating element 210 lies in a generally concentric, counterclockwise spiral around a center location that is common to both the outer heating element 212 and the inner heating element 210. In other embodiments, the coiled portions 223,224 may lie in a generally clockwise arrangement.

As shown in the figures, the end portions of cold legs 219,220,221,222 are arranged on top of one another and adjacent one another in a nested and compact arrangement from which a pair of terminals 234,236 extend for connecting to an electrical power source. More specifically, the end portion of cold leg 219 of inner heating element 210 is positioned beneath the end portion of cold leg 222 of outer heating element 212, and the end portion of cold leg 221 of inner heating element 210 is positioned beneath the end portion of cold leg 220 of outer heating element 212. The end portion of cold leg 219 is positioned adjacent to and side by side with the end portion of cold leg 221, and the end portion of cold leg 222 is positioned adjacent to and side by side with the end portion of cold leg 220. In other embodiments, the end portion of cold leg 219 is positioned adjacent to and side by side with the end portion of cold leg 222, and the end portion of cold leg 221 is positioned adjacent to and side by side with the end portion of cold leg 220.

Figure 20:
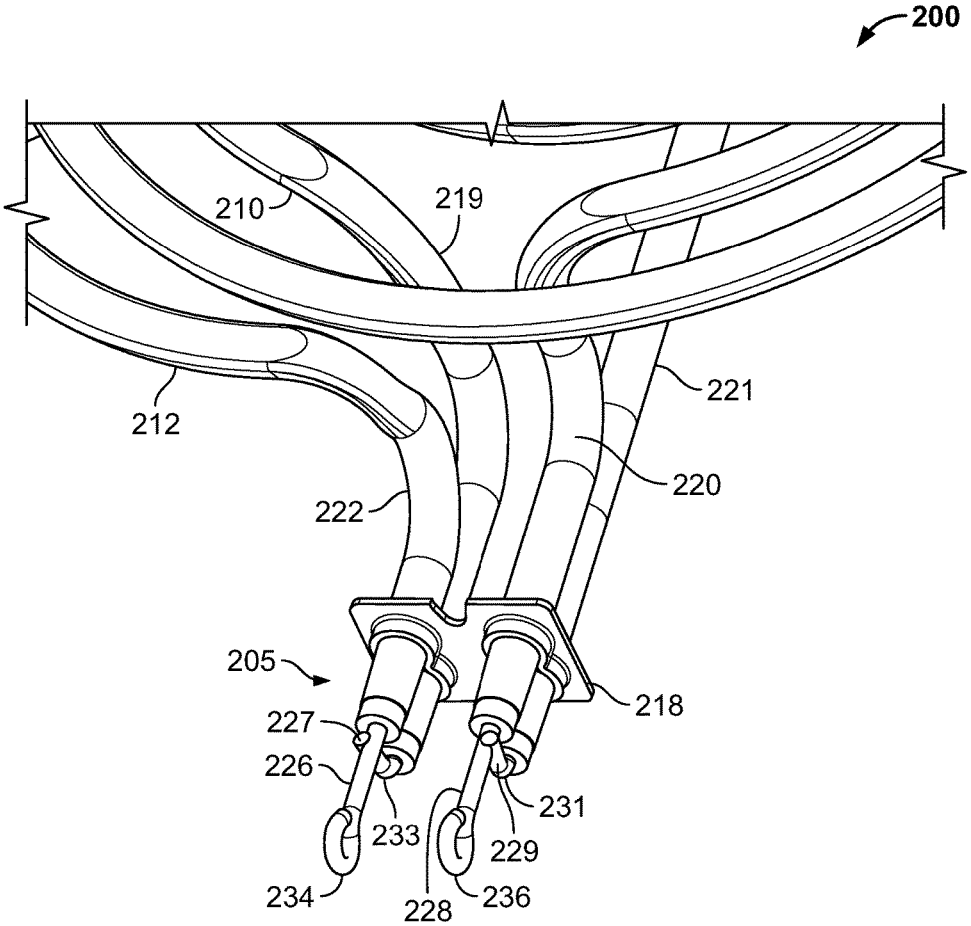
FIG. 20 is a partial perspective view of a portion of the heating element of FIG. 15.

To connect heating element 200 to an electrical power source, inner heating element 210 includes electrical terminals 231,233 extending from the end portions of cold legs 221,219, respectively, and outer heating element 212 includes electrical terminals 234,236 extending from the end portions of cold legs 222,220, respectively. As best shown in FIG. 20, terminal 231 is connected to terminal 236 and terminal 233 is connected to terminal 234. In this embodiment, the electrical conductor 229 of terminal 231 is bent upwardly and soldered or brazed to, or otherwise joined with, the electrical conductor 228 of terminal 236 at a location some distance away from the end of terminal 236. Similarly, the electrical conductor 227 of terminal 233 is bent upwardly and soldered or brazed to, or otherwise joined with, the electrical conductor 226 of terminal 234 at a location some distance away from the end of terminal 234. In other embodiments, terminals 231 and 233 may be jumpered to terminals 236 and 234, respectively. Positioning and connecting the conductors 227 and 229 to conductors 226 and 228, respectively, allows for direct connection of terminals 234 and 236 to an electrical power source on a conventional two-terminal receptacle stovetop, cooktop, or range appliance without requiring a 4 terminal-to-2-terminal adaptor or an appliance with 4 terminal receptacles.

Terminal bracket 218 supports respective cold legs 219, 220,221,222 and is configured to stabilize the inner and outer heating elements 210,212 relative to one another. Terminal bracket 218 may be positioned somewhat near the terminal end of cold legs 219,220,221,222 along the sheathed portion of cold legs 219,220,221,222. Terminal bracket 218 may include apertures, cutouts, grooves, straps, or other similar features to maintain position of each respective cold leg 219,220,221,222 relative to one another while supporting each of the cold legs 219,220,221,222 in space. Terminal bracket 218 may be configured to have a close fit or an interference fit with the outer perimeter of the cold legs 219,220,221,222.

In the embodiment shown in the figures, terminal bracket 218 includes a pair of apertures with peripheral walls that approximate the shape of an outer profile of the numeral "8," or alternatively, a symmetric peanut shell, having two cylindrical openings and a necked-down portion therebetween. The opening that lies in the necked-down portion is smaller than the diameter of the sheathed end of the cold legs 219,220,221,222 when the cold legs are secured to the bracket 218. The sheathed end of the cold legs 219,220,221, 222 may be slightly tapered to allow the terminal bracket 218 during assembly to slide onto and wedge against the cold legs 219,220,221,222. The apertures in the bracket 218 may be sized to snuggly fit the diameter along any portion of cold legs 219,220,221,222 near the terminal end. In other embodiments, the geometry and/or manner of securing bracket 218 to cold legs 219,220,221,222 may be different without departing from the scope of the instant disclosure.

Terminal bracket 218 may be configured from an electrically conductive material, such as a metal. Terminal bracket 218 may be configured from a thermally resistant material. Terminal bracket 218 may be used to electrically ground electric heating element 200. Terminal bracket 218 may be formed from a stamping, a forging, a casting, a machined article, a 3-D printed article, or any other suitable manufacturing method.

Spider bracket 217 is configured to support coiled portions 223,224 of the inner and outer heating elements 210,212, respectively, relative to one another. Spider bracket 217 may be configured with three legs arranged at approximately equal angles with respect to one another from a central location, as shown in the figures, or in any other quantity of legs, shape or configuration to support the inner and outer heating elements 210,212. Spider bracket 217 may include upwardly extending protrusions 246 on each leg so as to restrain and/or help maintain position of one or more portions of coiled portions 223,224 relative to spider bracket 217. In other embodiments, spider bracket 217 may include recessed receptacles formed in each leg to accomplish this purpose.

Heating elements 210,212 may include a tubular sheathed configuration. The cross sectional profile of heating elements 210,212 may include a generally trapezoidal shape with a flat top surface, downwardly sloped and opposed side walls, and a curved bottom wall positioned opposite the flat top surface and joined to the opposed side walls. A relatively small transitional radius may exist between the each of the side walls and the top flat surface. In other embodiments, the cross sectional profile of heating elements 210,222 may have any shape.

Electric heating element 200 may be controlled via conventional user commands, such as by a user interface including, for example, an analog, digital or virtual dial, knob, button, or device. Both heating elements 210,212 are energized and de-energized at the same time via the user interface to provide increased heat output over a conventional, single coil design.

Any of the features described with reference to FIGS. 1-20 may be combined into a single embodiment, even if not simultaneously shown in a single drawing figure. In addition, one of ordinary skill would appreciate that the teachings of the instant disclosure include electric heating elements with more than two heating coils.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

The invention claimed is:

1. An electric heating element, comprising:

an electrically resistive inner heating element including an inner coiled heating portion and first and second cold legs extending from the inner coiled heating portion for connection to an electrical power source;

an electrically resistive outer heating element including an outer coiled heating portion positioned in a first common plane with and around the inner coiled heating portion, the outer heating element including third and fourth cold legs extending from the outer coiled heating portion for connection to the electrical power source, the third and fourth cold legs positioned parallel to and in a second common plane with the first and second cold legs; and a controller positioned under the first common plane in proximity to the inner coiled heating portion and along one of the first and second cold legs, the controller configured to selectively open and close an electrical circuit to cycle off and on the inner coiled heating portion.

2. The electric heating element of claim 1, wherein the controller is coupled to a timer to enable the controller to open the electrical circuit after a predetermined amount of time has elapsed to turn off the inner coiled heating element while the outer coiled heating element remains energized.

3. The electric heating element of claim 1, including at least one temperature sensor coupled to the controller to detect a temperature associated with heat emitted from the inner heating element and/or the outer heating element.

4. The electric heating element of claim 3, wherein the controller includes a processor coupled to memory having software thereon that when executed causes the processor to selectively open and close the electrical circuit while the outer coiled heating element is energized.

5. The electric heating element of claim 4, wherein the controller is configured to dynamically modulate electrical current delivered to the inner coiled heating element.

6. The electric heating element of claim 1, wherein the controller is a thermostat configured to selectively open and close the electrical circuit to cycle off and on the inner coiled heating portion while the outer coiled heating element remains energized.

7. The electric heating element of claim 6, wherein the thermostat includes a bimetal material configured to: (a) open the electrical circuit upon detecting a predetermined high temperature associated with heat emitted from the inner heating element and/or the outer heating element, and (b) close the electrical circuit upon detecting a predetermined low temperature associated with heat emitted from the outer heating element.

8. The electric heating element of claim 7, including an enclosure for housing the thermostat.

9. The electric heating element of claim 8, wherein the enclosure comprises a stainless steel.

10. The electric heating element of claim 8, wherein the enclosure includes a first clamshell portion, a second clamshell portion, and a seal positioned therebetween.

11. The electric heating element of claim 8, wherein the enclosure is black on at least one surface.

12. The electric heating element of claim 3, including an enclosure for housing the controller and the at least one temperature sensor.

13. The electric heating element of claim 8, wherein the first common plane is parallel to the second common plane.

14. The electric heating element of claim 1, wherein the inner coiled heating portion and the outer coiled heating portion are configured to receive a cooking utensil directly thereon.

15. An electric heating element, comprising:

an electrically resistive inner heating element including an inner coiled heating portion and first and second cold legs extending from the inner coiled heating portion for connection to an electrical power source;

an electrically resistive outer heating element including an outer coiled heating portion positioned in a common plane with and around the inner coiled heating portion, the outer heating element including third and fourth cold legs extending from the outer coiled heating portion for connection to the electrical power source, the third and fourth cold legs positioned parallel to the first and second cold legs; and an electro-mechanical controlling device positioned under the common plane in proximity to the inner coiled heating portion and along one of the first and second cold legs, the electro-mechanical controlling device configured to selectively open and close an electrical circuit to cycle off and on the inner coiled heating portion.

16. The electric heating element of claim 15, wherein the electro-mechanical controlling device is a thermostat.

17. The electric heating element of claim 16, wherein the thermostat includes a bimetal material configured to: (a) open the electrical circuit upon detecting a predetermined high temperature associated with heat emitted from the inner heating element and/or the outer heating element, and (b) close the electrical circuit upon detecting a predetermined low temperature associated with heat emitted from the outer heating element.

18. The electric heating element of claim 15, including an enclosure for housing the electro-mechanical controlling device.

19. The electric heating element of claim 15, wherein the third cold leg is positioned adjacent to and directly above the first cold leg, the fourth cold leg is positioned adjacent to and directly above the second cold leg, and the third cold leg is positioned adjacent to and side by side the fourth cold leg.

20. The electric heating element of claim 15, including a bracket for supporting the first, second, third and fourth cold legs relative to one another, the bracket having an interference fit with the first, second, third, and fourth cold legs.

21. The electric heating element of claim 15, wherein the first, second, third and fourth cold legs are parallel to the common plane and extend radially past an outermost diameter of the outer coiled heating portion.

22. The electric heating element of claim 1, including first, second, third, and fourth electrical conductors extending from the first, second, third and fourth cold legs, respectively, wherein the first electrical conductor is connected to the third electrical conductor and the second electrical conductor is connected to the fourth electrical conductor, wherein the third and fourth electrical conductors are configured for engaging with an appliance electrical receptacle having a single pair of electrical conductor receiving ports.

23. The electric heating element of claim 15, wherein the inner coiled heating portion and the outer coiled heating portion are configured to receive a cooking utensil directly thereon.

24. An electric heating element, comprising:

an electrically resistive inner heating element including an inner coiled heating portion and first and second cold legs extending from the inner coiled heating portion for connection to an electrical power source;

an electrically resistive outer heating element including an outer coiled heating portion positioned in a common plane with and around the inner coiled heating portion, the outer heating element including third and fourth cold legs extending from the outer coiled heating portion for connection to the electrical power source, wherein the first, second, third and fourth cold legs are parallel to the common plane and extend radially past an outermost diameter of the outer coiled heating portion;

first, second, third, and fourth electrical conductors extending from the first, second, third and fourth cold legs, respectively, wherein the first electrical conductor is connected to the third electrical conductor and the second electrical conductor is connected to the fourth electrical conductor, wherein the third and fourth electrical conductors are configured for engaging with an appliance electrical receptacle having a single pair of electrical conductor receiving ports;

a thermostat housed in an enclosure under the common plane in proximity to the inner coiled heating portion and along one of the first and second cold legs, the thermostat configured to selectively open and close an electrical circuit to cycle off and on the inner coiled heating portion; and a bracket oriented perpendicularly to the first, second, third, and fourth cold legs and positioned near a terminal end of the first, second, third, and fourth cold legs, the bracket configured to restrain the first, second, third, and fourth cold legs and to separate the first, second, third, and fourth cold legs from one another.

25. The electric heating element of claim 24, wherein the inner coiled heating portion and the outer coiled heating portion are configured to receive a cooking utensil directly thereon.

* * * * *